US007425672B2

(12) United States Patent
Haba et al.

(10) Patent No.: US 7,425,672 B2
(45) Date of Patent: Sep. 16, 2008

(54) EXTERIOR STRUCTURE FOR KEYBOARD INSTRUMENT

(75) Inventors: Daisuke Haba, Hamamatsu (JP); Yuji Sakurai, Hamamatsu (JP); Masao Sato, Hamamatsu (JP); Toshiyuki Aiba, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/317,690

(22) Filed: Dec. 23, 2005

(65) Prior Publication Data

US 2006/0137509 A1 Jun. 29, 2006

(30) Foreign Application Priority Data

Dec. 24, 2004 (JP) ..... 2004-374052
Dec. 24, 2004 (JP) ..... 2004-374053

(51) Int. Cl.
*G10C 3/02* (2006.01)
*G10H 1/32* (2006.01)

(52) U.S. Cl. ..... 84/423 R; 84/177

(58) Field of Classification Search ..... 84/423 R, 84/718, 177
See application file for complete search history.

(56) References Cited

U.S. PATENT DOCUMENTS 3,740,448 A * 6/1973 Olszowka et al. ..... 84/600
4,091,707 A * 5/1978 Martin et al. ..... 84/423 R
4,130,044 A * 12/1978 Yamada et al. ..... 84/176
4,299,155 A * 11/1981 Kumano ..... 84/177
4,351,222 A * 9/1982 Kumano ..... 84/423 R
4,455,912 A * 6/1984 Tagaki ..... 84/177
D308,215 S * 5/1990 Katsuhara ..... D17/7
5,164,528 A * 11/1992 Arai et al. ..... 84/177
6,133,517 A * 10/2000 Masubuchi ..... 84/423 R
6,133,518 A * 10/2000 Kamimura et al. ..... 84/423 R
6,147,290 A * 11/2000 Uno ..... 84/433
6,180,859 B1 * 1/2001 Konishi ..... 84/174
D444,492 S * 7/2001 Saito ..... D17/1
7,326,844 B2 * 2/2008 Nishida ..... 84/423 R
2006/0137508 A1 * 6/2006 Sakurai ..... 84/423 R
2006/0137509 A1 * 6/2006 Haba et al. ..... 84/423 R

FOREIGN PATENT DOCUMENTS

GB 180769 6/1922
JP 02173790 A * 7/1990
JP 05323961 A * 12/1993
JP 10240254 A * 9/1998
WO WO-2004-013838 2/2004

* cited by examiner

*Primary Examiner*—Lincoln Donovan
*Assistant Examiner*—Robert W Horn
(74) *Attorney, Agent, or Firm*—Morrison & Foerster LLP

(57) ABSTRACT

An exterior structure for a keyboard instrument, which is capable of dramatically increasing the variation of producible types of keyboard instruments while suppressing the cost of molds. A lower case includes a front-side lower case LCf and a rear-side lower case LCr disposed rearward of the front-side lower case LCf in a side-by-side fashion. An upper case UC is disposed above the lower case. The front-side lower case LCf is fastened to the upper case UC, and the rear-side lower case LCr is fastened to the upper case UC, whereby the lower case is secured to the upper case UC.

15 Claims, 15 Drawing Sheets

EXTERIOR STRUCTURE FOR KEYBOARD INSTRUMENT

BACKGROUND OF THE INVENTION

1. Field of the Invention

The present invention relates to an exterior structure for a keyboard instrument, which includes a case structure of a multi-case coupled type for mounting a keyboard unit therein.

2. Description of the Related Art

Conventionally, as disclosed e.g. in the publication of Japanese Utility Model Registration No. 2545353, an exterior structure for a keyboard instrument is known in which two upper case of respective types are selectively combined with one lower case of a single type, thereby enabling two types of case structures to be constructed. In general, in the exterior structure of this kind, the upper cases and the lower case are made of resin and shaped using molds. Screw pilot holes are formed in each upper case, and clearance holes for screwing screws are formed in the lower case in a manner associated with the screw pilot holes. Then, the two cases are secured to each other by screwing the screws from below.

In this type of exterior structure, however, when the angle of the panel surface of each upper case is desired to be changed according to the type of keyboard instrument, for example, to prevent undercuts from being formed in portions of a mold associated with the screw pilot holes, it is desirable that the screw pilot holes in the upper case are formed to be approximately perpendicular to the panel surface. However, when a screw pilot hole is formed to be perpendicular to the panel surface, it is also desirable that the angle of a surface of the lower case, with which the head of a screw is brought into contact, is set according to the angle of the screw pilot hole (such that the surface of the lower case becomes perpendicular to the screw pilot hole). This makes it difficult to share or commonly use the lower case between the different types of keyboard instruments.

On the other hand, it is contemplated that the screw pilot holes in the upper cases are formed to be elongated in cross section perpendicular to the axis thereof such that screws can be screwed obliquely into the elongated screw pilot holes, to thereby enable a large number of upper cases of respective types to be selectively assembled to one lower case of a single type. In this case, however, each screw mates with only parts of the elongated screw pilot hole along shorter sides thereof to form an exposed part, which degrades fastening rigidity of the screw. Further, the screw is difficult to advance straight during screwing, which degrades fastening accuracy thereof. Moreover, an elliptic projection associated with the elongated hole has to be formed on the mold, and hence it becomes more difficult to machine the mold than when a hole circular in cross-section is formed, which results in an increase in the cost of the mold.

Further, when a lower case of one type is commonly used or shared between various types of keyboard instruments, even if a plurality of upper cases are provided, the depth of each keyboard instrument and the shape thereof in plan view are determined depending on the lower case, and hence from the viewpoint of design and installation stability thereof, the depth of the upper case in particular cannot be increased, which makes it difficult to manufacture keyboard instruments different in size between different types thereof.

For the above-described reasons, if it is a prerequisite to reduce the cost of molds, there are significant restrictions imposed on the design of upper cases, and in actuality, it is difficult to cope with production of various types of keyboard instruments by sharing the lower case and changing only upper cases on an instrument type-by-instrument type basis. Therefore, the fact is that the number of types of keyboard instruments that can be manufactured is limited.

Further, in the exterior structure of the above-mentioned kind, the upper and lower cases are originally formed as separate members, so that unless portions thereof via which the two cases are assembled are deliberately configured, there is a fear that the rigidity of the whole case structure decreases. Further, if the case structure is constructed by combining three or more separate case members, there is an increased fear that the rigidity of the whole case structure decreases. Furthermore, when a keyboard unit demanding high mounting accuracy is mounted in the case structure, whether or not the accuracy can be maintained largely depends on the structure of portions of the upper and lower cases via which they are assembled to each other, and portions of the same via which the keyboard unit is mounted.

SUMMARY OF THE INVENTION

It is a first object of the present invention to provide an exterior structure for a keyboard instrument, which is capable of dramatically increasing the variation of producible types of keyboard instruments while suppressing the cost of molds.

It is a second object of the present invention to provide an exterior structure for a keyboard instrument, formed by coupling three separately formed cases, which is capable of increasing the connecting strength of lower cases to thereby ensure the rigidity of a case structure of the keyboard instrument.

To attain the above object, in a first aspect of the present invention, there is provided an exterior structure for a keyboard instrument, including a case structure for mounting a keyboard unit (KBU) therein, comprising a lower case (LCf+LCr) including a front-side lower case (LCf), and a rear-side lower case (LCr) disposed rearward of the front-side lower case in a side-by-side fashion, and an upper case (UC) disposed above the lower case (LCf+LCr), wherein the front-side lower case (LCf) is fastened to the upper case and the rear-side lower case is fastened to the upper case (UC), whereby the lower case is secured to the upper case.

With the arrangement of this exterior structure, according to the first aspect of the present invention, it is possible to dramatically increase the variation of producible types of keyboard instruments while suppressing the cost of molds. Further, in the case structure constructed by three separate case components, the connecting strength of the lower cases can be increased to thereby ensure high rigidity of the case structure.

Preferably, the upper case (UC) has at least one first fastening part (16) and at least one second fastening part (17), the front-side lower case (LCf) having at least one first fastening part-associated part (26) associated with the first fastening part of the upper case and at least one second fastening part-associated part (28) associated with the second fastening part of the upper case, and the exterior structure further comprising at least one first fastening member (64) for fastening the first fastening part (16) of the upper case (UC) and the first fastening part-associated part (26) of the front-side lower case (LCf) and at least one second fastening member (65) for fastening the second fastening part (17) of the upper case (UC) and the second fastening part-associated part (28) of the front-side lower case (LCf), and the first fastening part (16) has a fixing part (16*a*) for fixing the first fastening member (64) thereto, the second fastening part (17) having a fixing part (17*a*) for fixing the second fastening member (65) thereto, the first fastening part-associated part (26) having a contact surface (26*b*2) curved in cross section, for contact with the first fastening member (64), the second fastening part-associated part (28) having a contact surface (28*a*) curved in cross-section, for contact with the second fastening member (65).

Preferably, the lower case (LCf+LCr) includes at least one guide part (30) for guiding a cable (66) for electrical wiring of the keyboard unit (KBU) in a rearward direction.

Preferably, the upper case (UC) has at least one third fastening part (13), the rear-side lower case (LCr) having at least one third fastening part-associated part (39) associated with the third fastening part of the upper case, and the exterior structure further comprising at least one third fastening member (61) for fastening the third fastening part of the upper case and the third fastening part-associated part of the rear-side lower case.

Preferably, the exterior structure further comprises a speaker provided between the rear-side lower case and an associated part of the upper case associated with the rear-side lower case.

To attain the above first object, in a second aspect of the present invention, there is provided an exterior structure for a keyboard instrument, including a case structure (UC+LCf+LCr) for mounting a keyboard unit (KBU) therein, comprising an upper case (UC) including at least one first fastening part (16, 17) and at least one second fastening part (13, 14, 15), a front-side lower case (LCf) including at least one first fastening part-associated part (24, 29) associated with the first fastening part (16, 17) of the upper case, and a rear-side lower case (LCr) disposed below the upper case (UC) and rearward of the front-side lower case (LCf), and including at least one second fastening part-associated part (40, 38, 34) associated with the second fastening part (13, 14, 15) of the upper case, and the first fastening part of the upper case and the first fastening part associated part of the front-side lower case are fastened to each other, and the second fastening part of the upper case and the second fastening part-associated part of the rear-side lower case are fastened to each other, whereby the front-side lower case and the rear-side lower case are secured to the upper case to thereby construct the case structure.

With the arrangement of the exterior structure according to the second aspect of the present invention, a case structure is constructed by three separately-formed cases such that a plurality of types of case structures can be constructed by combination of individual case. Therefore, it is possible to dramatically increase the variation of producible types of keyboard instruments while suppressing the cost of molds.

Preferably, the front-side lower case (LCf) and the rear-side lower case (LCr) have overlapping parts (CN2) at which the front-side lower case and the rear-side lower case are coupled to each other in a manner overlapping each other in a front-rear direction, the exterior structure comprising a keyboard unit-supporting part (26*b*) for supporting the keyboard unit (KBU) being formed at the overlapping parts of the front-side lower case and the rear-side lower case.

With the arrangement of the preferred embodiment, it is possible to ensure the rigidity of the whole case structure. It is further preferred that at least one of first fastening parts (16) and at least one of second fastening parts (15) of the upper case are disposed in a corresponding part of the overlapping part of the lower cases. With the arrangement, the keyboard unit is supported at a location where the upper case and the lower cases are fastened to each other. Therefore, it is possible to enhance the mounting accuracy of the keyboard instrument.

Preferably, the upper case (UC) includes left and right side sections extending over a length of the case structure (KBU+LFc) in a front-rear direction thereof, and the left and right sections have at least one first fastening part (16, 17) and at least one second fastening part (13, 14, 15), respectively.

With the arrangement of the preferred embodiment, the front-side lower case and the rear-side lower case are fixed using the left and right side sections of the upper case practically as connecting parts. Therefore, it is possible to increase the rigidity of the case structure in a front-rear direction thereof.

To attain the above first object, in a third aspect of the present invention, there is provided an exterior structure for a keyboard instrument, including a case structure, comprising a plurality of respective types of upper cases (UC, UC2, UC3), a plurality of respective types of rear-side lower cases (LCf, LCf2, LCf3), and a single type of a front-side lower case (LCr) for supporting a keyboard unit (KBU), and the case structure is constructed by selectively mounting one of the plurality of respective types of upper cases and one of the plurality of respective types of rear-side lower cases to the front-side lower case.

With the arrangement of the exterior structure according to the third aspect of the present invention, one of a plurality of upper cases of respective types and one of a plurality of rear-side lower cases of respective types are selectively mounted to a front-side lower case such that a plurality of types of case structures can be constructed, whereby it is possible to dramatically increase the variation of producible types of keyboard instruments while suppressing the cost of molds.

To attain the above second object, in a fourth aspect of the present invention, there is provided an exterior structure for a keyboard instrument, including a case structure for mounting a keyboard unit (KBU) therein, comprising an upper case (UC), a front-side lower case (LCf), a rear-side lower case (LCr) disposed below the upper case and rearward of the front-side lower case, and a fastening device (61 to 65); the case structure is constructed by assembling the upper case, the front-side lower case, and the rear-side lower case; wherein the front-side lower case and the rear-side lower case each have a wall (26*a*, 26*c*, 26*b*3, 31, 33*a*, 33*c*, 35*a*, 35*c*, 42) extending in a substantially vertical direction; and the wall (26*a*, 26*c*, 26*b*3) of the front-side lower case and the wall (31, 33*a*, 33*c*, 35*a*, 35*c*, 42) of the rear-side lower case are arranged close to each other in opposed relation, when the upper case, the front-side lower case, and the rear-side lower case are assembled to each other, and fastened by the fastening device.

With the arrangement of the exterior structure according to the fourth aspect of the present invention, since the wall of the front-side lower case and the wall of the rear-side lower case are arranged close to each other in opposed relation, which increases the strength of the assembled lower case in a horizontal direction. Therefore, in the case structure constructed by three separate case components, the connecting strength of the lower cases can be increased to thereby ensure high rigidity of the case structure.

Preferably, one of the front-side lower case (LCf) and the rear-side lower case (LCr) has a floor part (26*b*), and the other of the front-side lower case and the rear-side lower case has a floor part-associated part (33*b*, 35*b*) associated with the floor part, the floor part being formed to extend in a manner continued from the wall (26*a*, 26*b*) of the one of the front-side lower case and the rear-side lower case, the upper case, the front-side lower case, and the rear-side lower case being assembled to each other by bringing the floor part and the floor part-associated part into contact with each other, and fastening the front-side lower case and the rear-side lower case to the upper case by the fastening device (61 to 65) at parts of the floor part and the floor part-associated part via which the floor part and the floor part-associated part are in contact with each other.

With the arrangement of the preferred embodiment, strength of a connecting part for connecting the front-side lower case and the rear-side lower case is increased.

Preferably, the floor part (26*b*) has a keyboard unit-supporting part (26*b*) for supporting the keyboard unit (KBU), and the floor part extends on the floor part-associated part in an overlapping manner when the upper case, the front-side lower case, and the rear-side lower case are assembled to each other.

With the arrangement of the preferred embodiment, a part for supporting the keyboard unit belongs to one of the front-side lower case and the rear-side lower case, and therefore it is possible to solve the problem of the degradation of positioning accuracy of the keyboard unit caused by constructing the lower case by two separate components.

Preferably, the keyboard unit-supporting part (26*b*) has a protrusion (27*f*, 27*r*) for contact with the keyboard unit (KBU) so as to function as a positioning reference of the keyboard unit in a front-rear direction thereof.

With the arrangement of the preferred embodiment, it is possible to facilitate the operation for assembling the keyboard unit. It should be noted that if protrusions are formed to have a ridge shape in a key arrangement direction, it is also possible to increase the rigidity of the lower case.

To attain the above second object, in a fifth aspect of the present invention, there is provided an exterior structure for a keyboard instrument, including a case structure for mounting a keyboard unit (KBU) therein, comprising an upper case (UC), a front-side lower case (LCf) including a bottom plate part (25), a rear-side lower case (LCr) disposed below the upper case and rearward of the front-side lower case, and a fastening device (63, 64), and the case structure is constructed by assembling the upper case, the front-side lower case, and the rear-side lower case, the front-side lower case having a gutter-shaped part (26) formed such that the gutter-shaped part rises from a rear part of the bottom plate part to define a recess opening downward, the gutter-shaped part having a keyboard unit-supporting part (26*b*) formed in an upper part thereof, for supporting the keyboard unit, the rear-side lower case having at least one connecting protrusion (33, 35) formed at a front part thereof in a manner protruding upward for being fitted into the recess of the gutter-shaped part, and the fastening device fastening the upper case, the keyboard unit, the front-side lower case, and the rear-side lower case to each other via contact parts of the gutter-shaped part and the connecting protrusion where the gutter-shaped part and the connecting protrusion are brought into contact with each other in a vertical direction, by fitting the connecting protrusion into the recess of the gutter-shaped part.

With the arrangement of the exterior structure according to the fifth aspect of the present invention, a part for supporting the keyboard unit belongs to the front-side lower case, which makes it possible to solve the problem of unacceptable degradation of positioning accuracy of the keyboard unit. Further, since a coupling protrusion is fitted in a gutter-shaped part, the rigidity of the lower case in the key arrangement direction is high. Therefore, in the case structure constructed by three separate case components, it is possible to increase connecting strength of the lower cases to thereby ensure high rigidity of the case structure, and ensure high positioning accuracy of the keyboard unit.

It should be noted that the above symbols such as reference numerals and the like are added to help so that the present invention may be understood and show an example of the present invention, and that, therefore, the above symbols do not correspond to all embodiments of the present invention.

The above and other objects, features and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
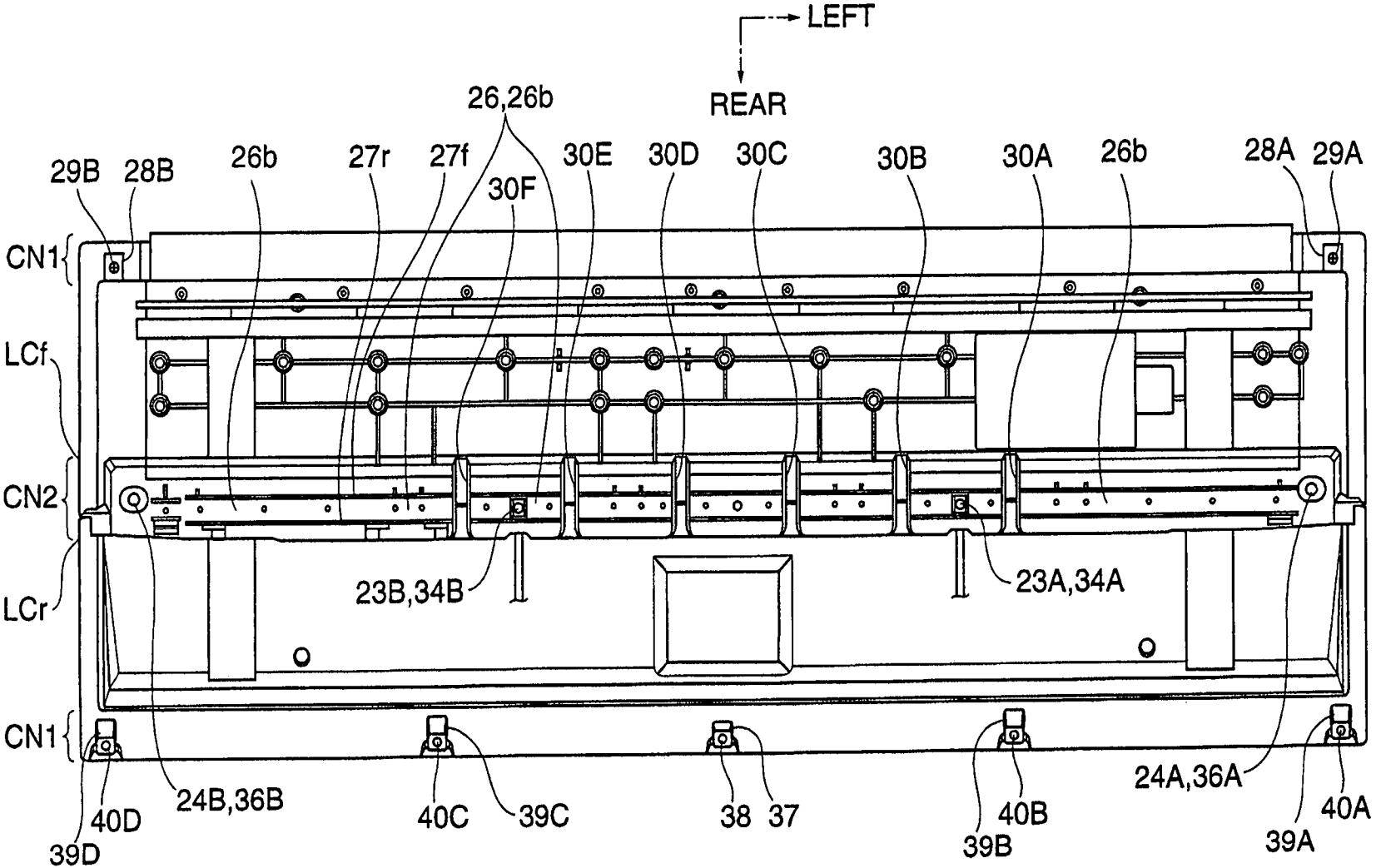
FIG. 1 is a plan view of a first keyboard instrument to which is applied an exterior structure according to an embodiment of the present invention, with a keyboard unit and an upper case removed therefrom.
Figure 2:
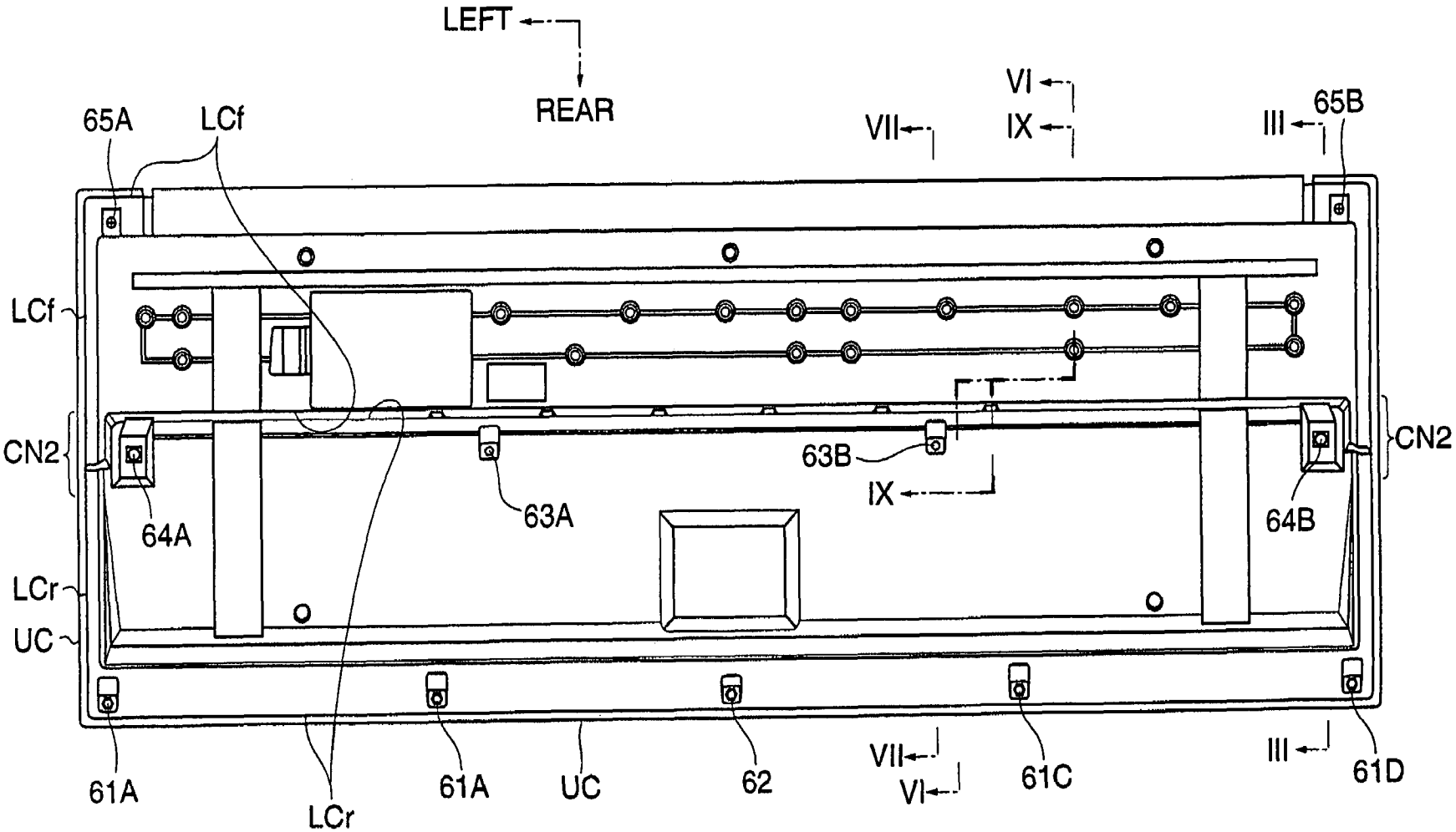
FIG. 2 is a bottom view of the first keyboard instrument appearing in FIG. 1.
Figure 3:
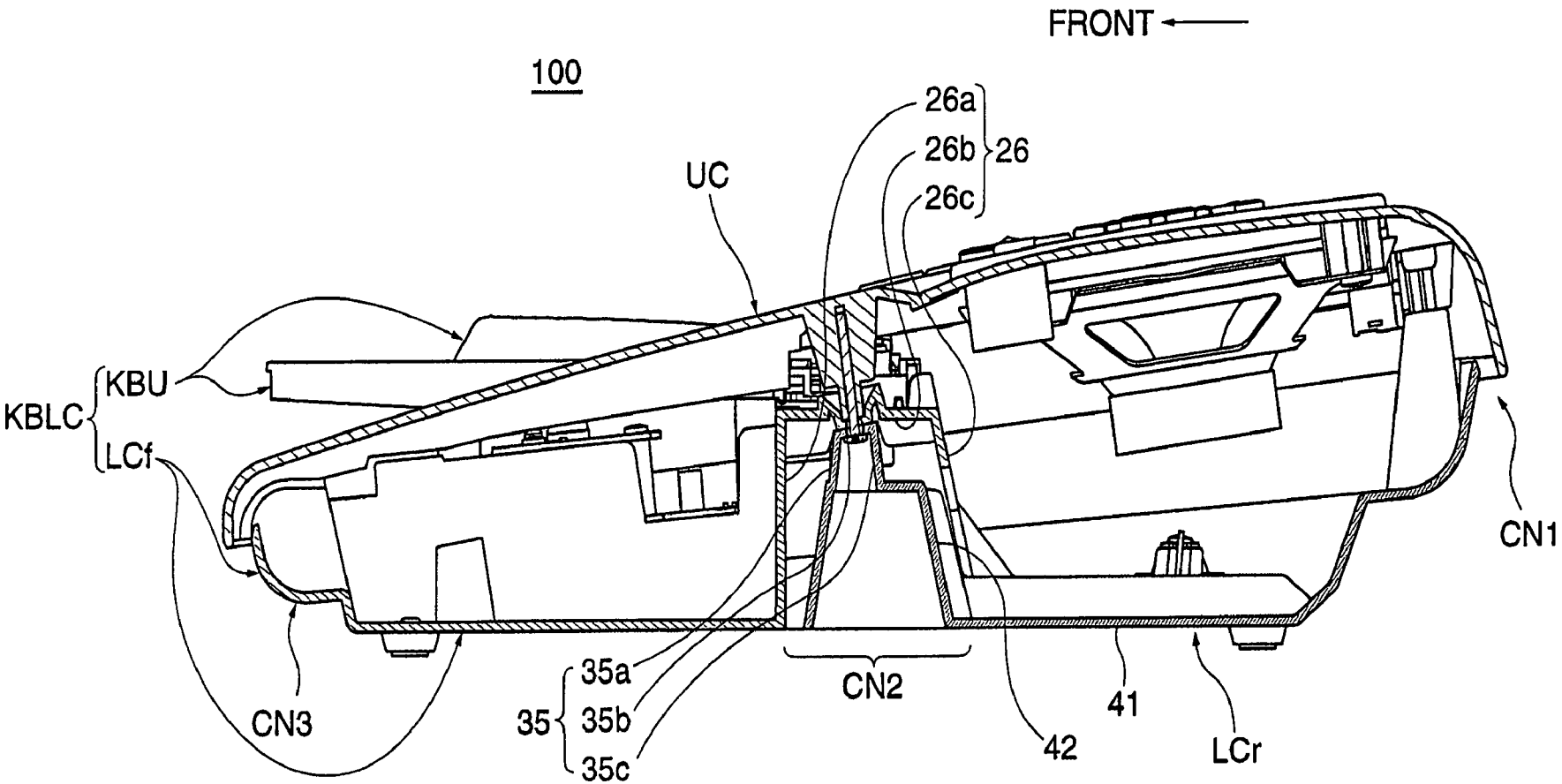
FIG. 3 is a cross-sectional view taken on line III-III of FIG. 2.

FIG. 1 is a plan view of a keyboard instrument to which is applied an exterior structure according to an embodiment of the present invention, with a keyboard unit and an upper case removed from the keyboard instrument. FIG. 2 is a bottom view of the keyboard instrument. FIG. 3 is a cross-sectional view taken on line III-III of FIG. 2.

Referring to FIG. 3, according to the exterior structure of the present embodiment, the keyboard instrument 100 is constructed by assembling a keyboard unit KBU, a front-side lower case LCf, an upper case UC, and a rear-side lower case LCr, all of which are made of resin. Hereafter, an assembly formed by assembling the keyboard unit KBU and the front-side lower case LCf will be referred to as "the keyboard-assembled front-side lower case KBLC". Further, an assembly formed by assembling the front-side lower case LCf, the upper case UC, and the rear-side lower case LCr corresponds to an exterior in which the keyboard unit KBU is mounted, and hence the assembly is also referred to as "the case structure".

Figure 15:
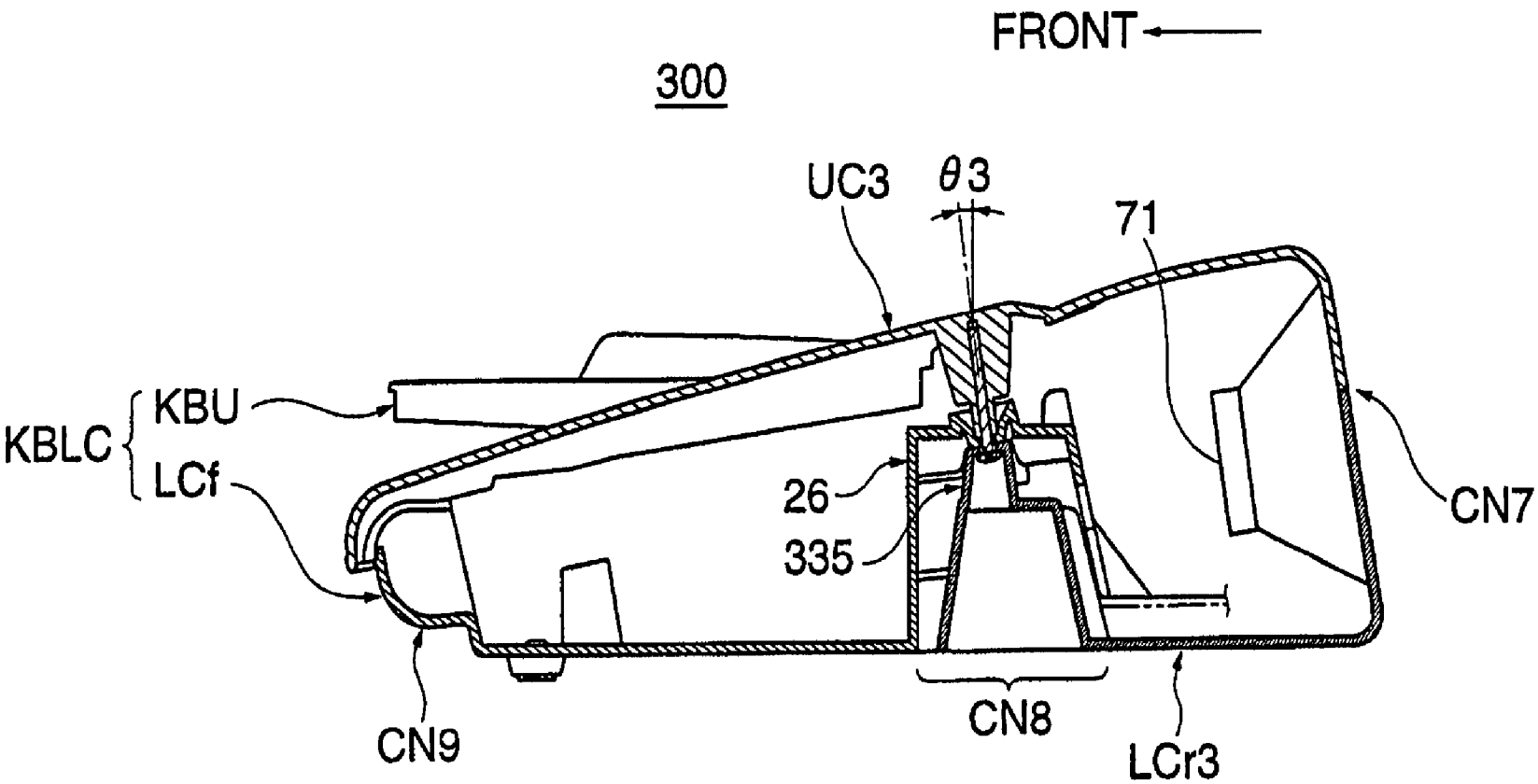
FIG. 15 is a cross-sectional view of the construction of a third keyboard instrument, which corresponds to FIG. 3 showing the construction of the keyboard instrument shown in FIG. 1.

Further, as described hereinafter, in place of the upper case UC and the rear-side lower case LCr, an upper case UC2 and a rear-side lower case LCr2 are assembled to the keyboard-assembled front-side lower case KBLC to thereby construct a keyboard instrument 200 (FIG. 11), and an upper case UC3 and a rear-side lower case LCr3 are assembled to the keyboard-assembled front-side lower case KBLC to thereby construct a keyboard instrument 300 (FIG. 15). That is, in the present embodiment, it is possible to construct a plurality of different types of keyboard instruments by using the keyboard-assembled front-side lower case KBLC in common therebetween and selectively assembling upper cases and rear-side lower cases, which are different in construction, to the keyboard-assembled front-side lower case KBLC.

In the following, the first to third keyboard instruments 100, 200, and 300 will be described as the plurality of different types of keyboard instruments, by way of example. The keyboard instrument 100 is described with reference to FIGS. 1 to 10, the keyboard instrument 200 with reference to FIGS. 11 to 14, and the keyboard instrument 300 with reference to FIG. 15. In the following descriptions of the keyboard instruments 100, 200, and 300, a player's side of each keyboard instrument will be referred to as "front", and a vertical direction and a left-right (lateral) direction will be referred to with respect to the player.

First, a description will be given of the keyboard instrument 100.

Figure 4:
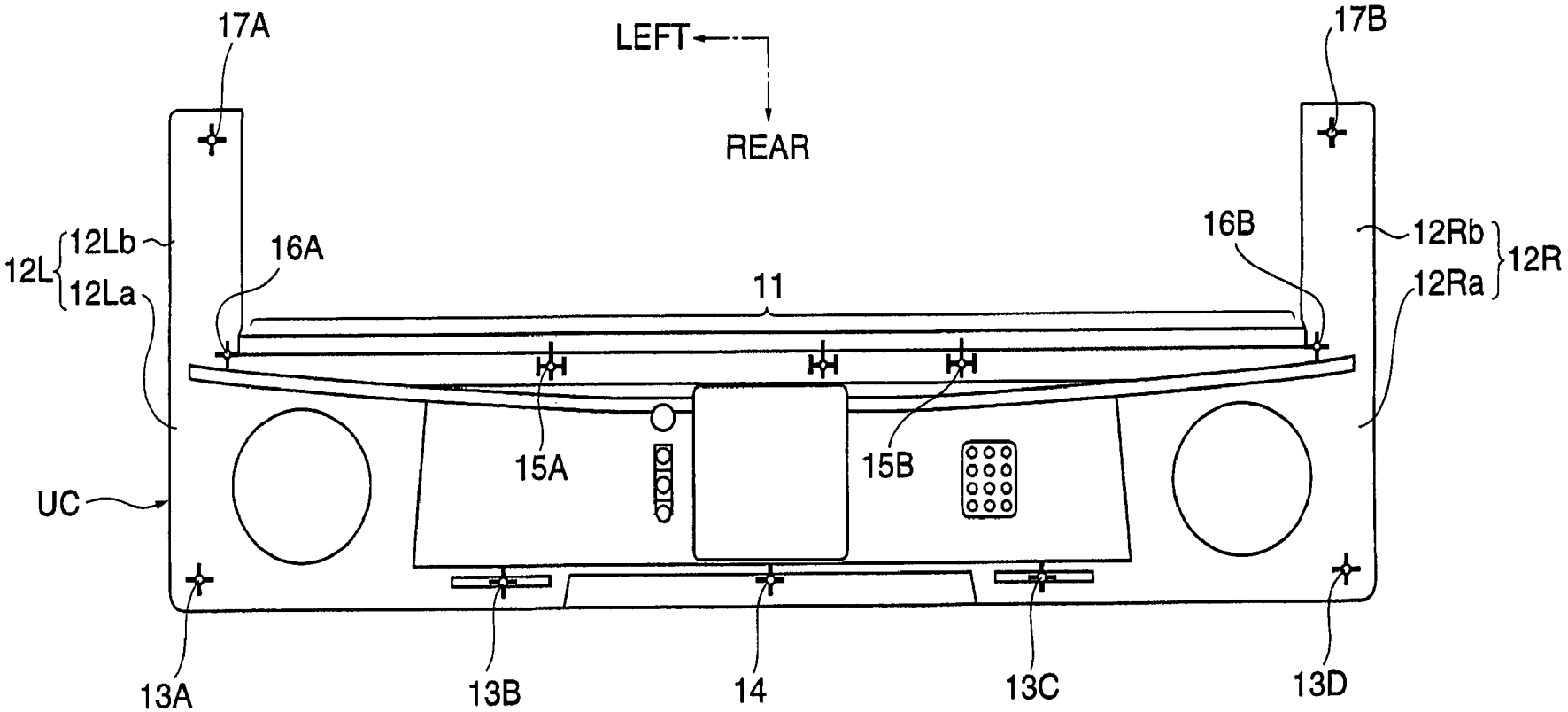
FIG. 4 is an underside view of the upper case.

FIG. 4 is an underside view of the upper case UC. The upper case UC has a general C shape in plan view, and is comprised of a main section 11 and left and right side sections 12 (12L, 12R) integrally formed with the main section 11. The left and right side sections 12L and 12R are formed over almost the whole length of the keyboard instrument 100 in the front-rear direction thereof. The left side section 12L is comprised of a rear part 12La, and an extending part 12Lb extending forward from the rear part 12La. The right side section 12R is comprised of a rear part 12Ra, and an extending part 12Rb extending forward from the rear part 12Ra.

A plurality of fastening protrusions 13 to 17 are formed on the upper case UC in a manner protruding downward therefrom. The fastening protrusions 13 to 17 each have a screw pilot hole (referred to hereinafter). The upper case UC has a rear part formed with four fastening protrusions 13 (13A to 13D), and a single fastening protrusion 14. The fastening protrusion 14 is located in the center of the upper case UC in the left-right direction thereof, and the fastening protrusions 13 are arranged in a manner distributed in the left-right direction. The main section 11 has a front part formed with two fastening protrusions 15 (15A and 15B). In the approximate center of the upper case UC in the front-rear direction thereof, fastening protrusions 16 (16A and 16B) are formed in the left and right side sections 12L and 12R, respectively. The fastening protrusions 16 are located slightly forward of the fastening protrusions 15. Further, there are formed fastening protrusions 17 (17A and 17B) in the respective front parts of the left and right side sections 12L and 12R, respectively.

Referring to FIG. 3, as will be described in detail hereinbelow, the front-side lower case LCf and the rear-side lower case LCr are connected to each other such that they overlap each other in an intermediate connecting part CN2 (FIGS. 1 to 3). Further, the rear-side lower case LCr and the upper case UC are connected to each other in a rear-side connecting part CN1 and the intermediate connecting part CN2, while the front-side lower case LCf and the upper case UC are connected to each other in the intermediate connecting part CN2 and a front-side connecting part CN3 (see FIG. 10B). The keyboard unit KBU is mounted in the front-side lower case LCf at the intermediate connecting part CN2.

Figure 5:
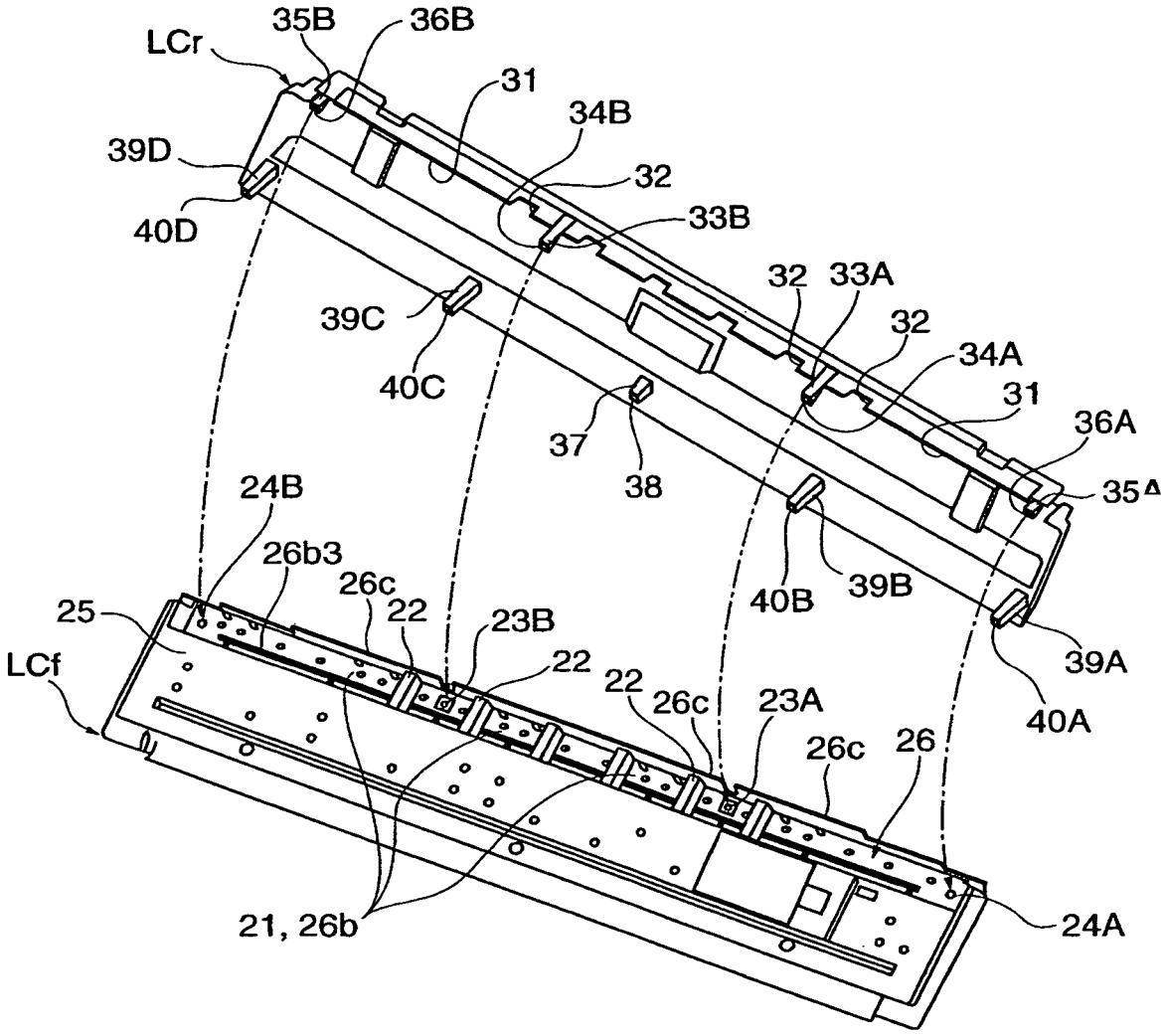
FIG. 5 is a perspective view useful in explaining how a front-side lower case and a rear-side lower case are assembled to each other.

FIG. 5 is a perspective view useful in explaining how the front-side lower case LCf and the rear-side lower case LCr are assembled to each other. In FIG. 5, the bottom side of the front-side lower case LCf and the top side of the rear-side lower case LCr are shown.

The front-side lower case LCf corresponds to a front half of the keyboard instrument 100. As shown in FIG. 1, two fastening protrusions 28 (28A and 28B) are formed on the laterally opposite sides of the front part of the front-side lower case LCf in a manner protruding upward therefrom. The fastening protrusions 28 are arranged at locations corresponding to the fastening protrusions 17 (see FIG. 4) of the upper case UC. The fastening protrusions 28 are formed with respective screw insertion holes 29 (29A and 29B), which are clearance holes for screws for fastening.

As shown in FIGS. 1 and 5, the front-side lower case LCf has a rear part formed with two screw insertion holes 23 (23A and 23B), and two screw insertion holes 24 (24A and 24B), which are clearance holes for screws for fastening. The screw insertion holes 23 and 24 are formed at locations corresponding to the fastening protrusions 15 and 16 of the upper case UC.

On the other hand, the rear-side lower case LCr corresponds to a rear half of the keyboard instrument 100. As shown in FIG. 5, two fastening protrusions 33 (33A and 33B) and two fastening protrusions 35 (35A and 35B) are formed on a front part of the rear-side lower case LCr in a manner protruding upward therefrom. The fastening protrusions 33 and 35 are formed at locations corresponding to the fastening protrusions 15 and 16 of the upper case UC. Screw insertion holes 34 (34A and 34B), and 36 (36A and 36B), which are clearance holes for screws for fastening, are formed in the fastening protrusions 33 and 35 in a manner associated with the screw insertion holes 23 and 24 of the front-side lower case LCf, respectively. Therefore, the screw insertion holes 34 and 36 are formed at locations corresponding to the screw insertion holes 23 and 24, and at the same time the fastening protrusions 15 and 16 also corresponds to these screw insertion holes in an overlapping manner.

Figure 6:
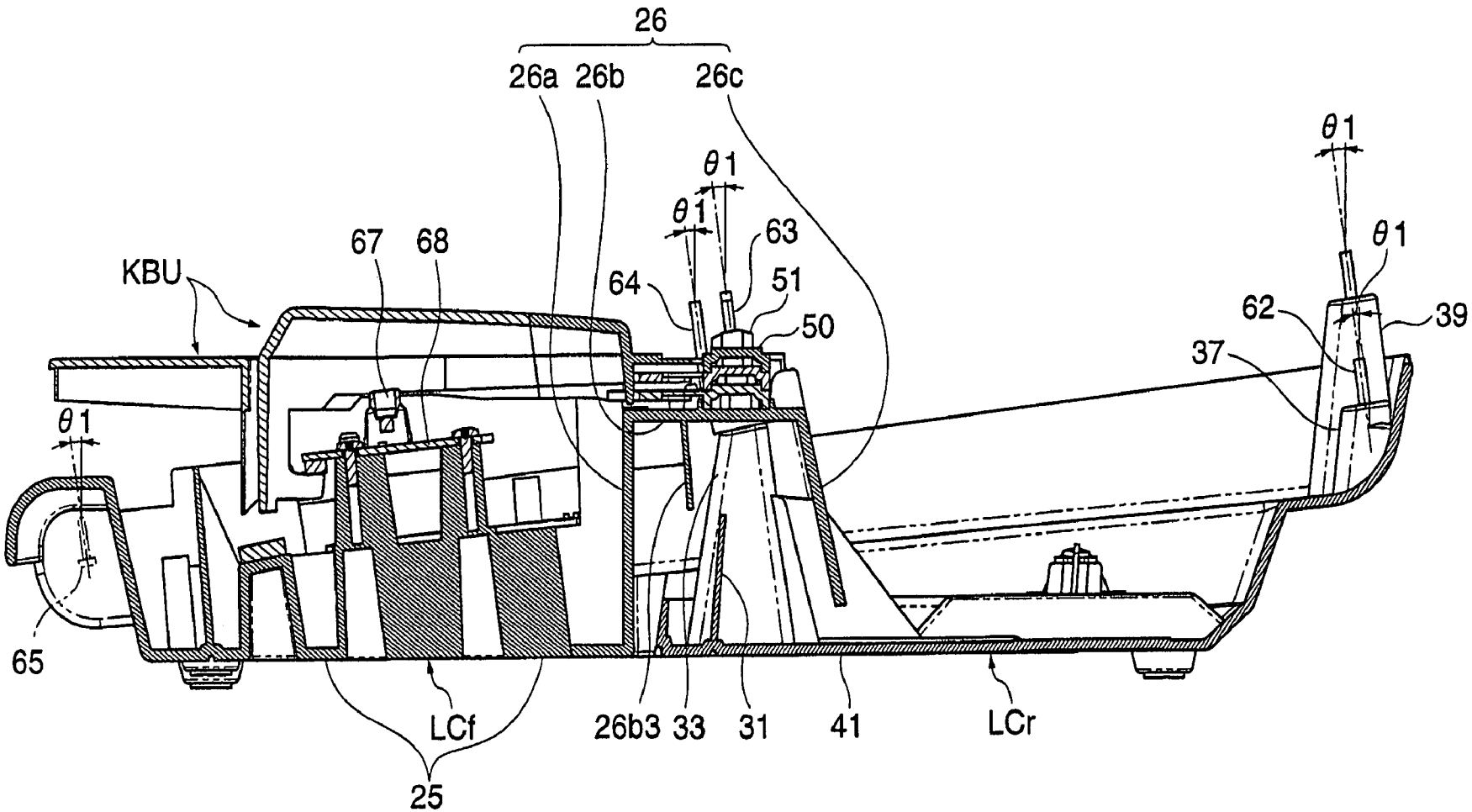
FIG. 6 is a cross-sectional view taken on line VI-VI of FIG. 2.

Further, as shown in FIG. 5, four fastening protrusions 39 (39A to 39D) and a single fastening protrusion 37 are formed on a rear part of the rear-side lower case LCr in a manner protruding upward therefrom (see FIG. 6 as well). The fastening protrusions 39 and 37 are formed at locations corresponding to the fastening protrusions 13 and 14 of the upper case UC. The fastening protrusions 39 (39A to 39D) and 37 are formed with respective screw insertion holes 40 (40A to 40D) and 38, which are clearance holes for screwing screws for fastening.

Figure 7:
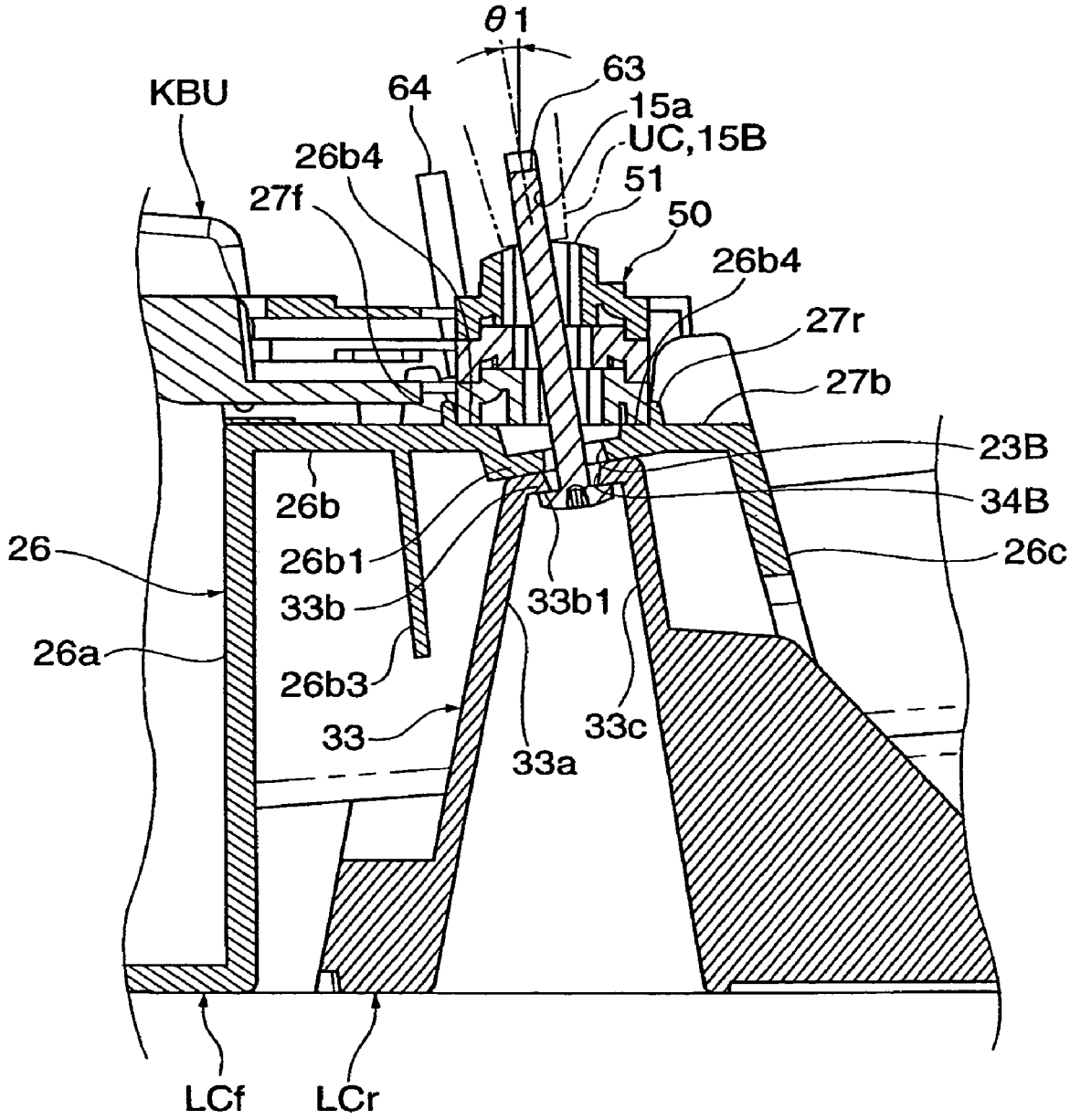
FIG. 7 is a cross-sectional view taken on line VII-VII of FIG. 2.
Figure 8:
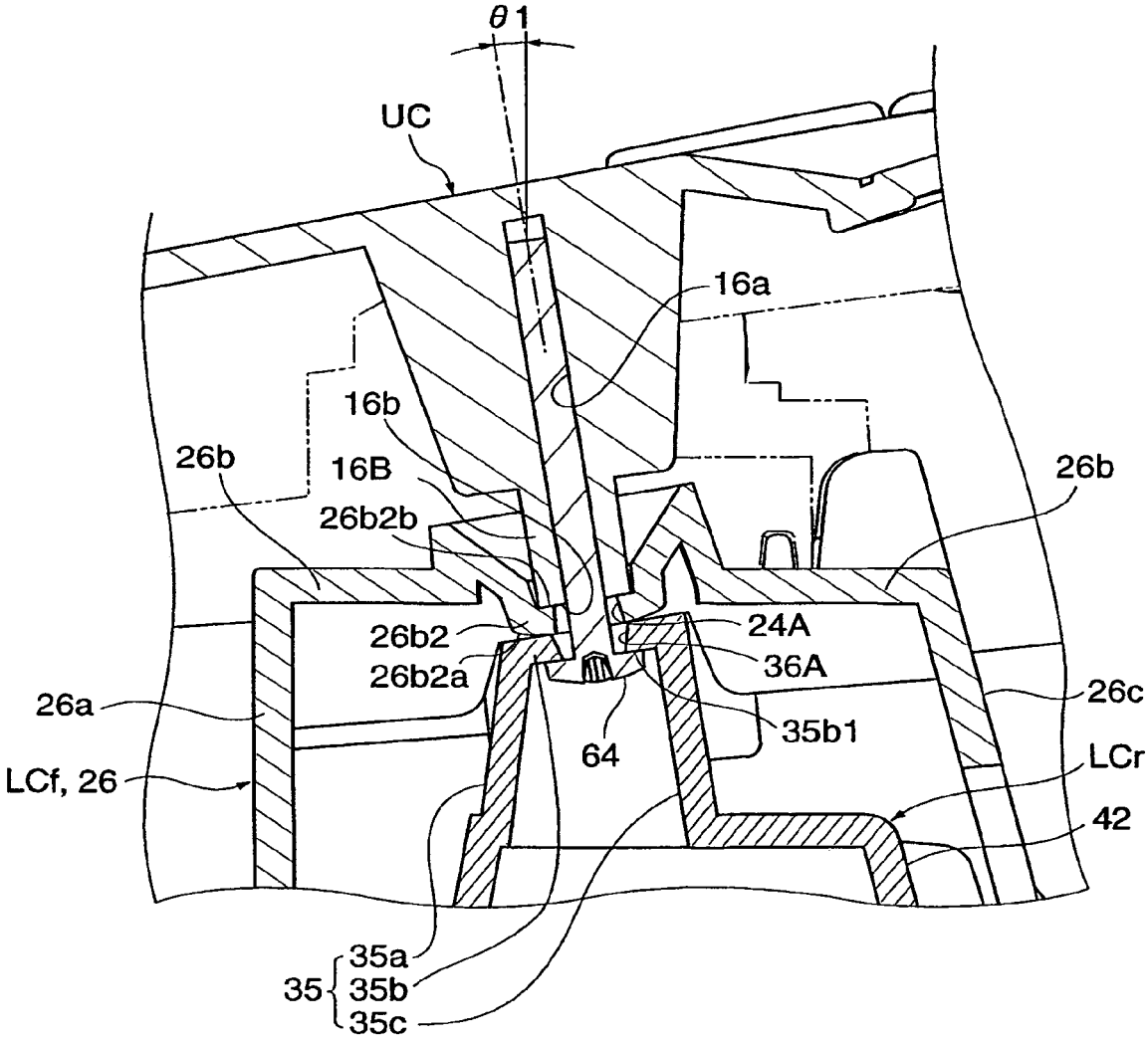
FIG. 8 is a fragmentary enlarged view of an intermediate connecting part shown in FIGS. 2 and 3.

FIG. 6 is a cross-sectional view taken on line VI-VI of FIG. 2, and FIG. 7 is a cross-sectional view taken on line VII-VII of FIG. 2. FIG. 8 is a fragmentary enlarged view of the intermediate connecting part CN2 appearing in FIGS. 2 and 3.

First, when attention is paid to the intermediate connecting part CN2, a gutter-shaped part 26, which is generally C-shaped in cross section and defines a recess opening downward, is formed in the rear part of the front-side lower case LCf, as shown in FIGS. 1, 5, 6, and 7. Referring to FIGS. 6 and 7, the gutter-shaped part 26 is mainly comprised of a rising part 26*a* rising from a rear part of a bottom plate 25 of the front-side lower case LCf, a floor part 26*b* substantially horizontally extending backward from the rising part 26*a*, and a hanging rib 26*c* extending downward from a rear end of the floor part 26*b*. It should be noted that the degree of the "substantial horizontalness" of the floor part 26*b* may be such that each key of the keyboard unit KBU is substantially horizontal when no depressing force is applied to the key, and the "substantial horizontalness" includes a wide range of angles except for "perpendicularity".

As shown in FIG. 1, six grooves 30 (30A to 30F) for passing flat cables 66 (see FIG. 9), described hereinafter, therethrough, are formed inside (in an upper side of) the gutter-shaped part 26 in the front-rear direction such that they open upward.

As shown in FIGS. 1 and 7, two ridge-like guide rails 27*f* and 27*r* are formed on an upper surface 26*b*4 of the floor part 26*b* over almost the whole width of the keyboard instrument 100 except for the positions of the grooves 30. The guide rails 27*f* and 27*r* serve as provisional positioning references for positioning common base ends 50 of the keyboard unit KBU in the front-rear direction.

Each groove 30 is formed such that the floor part 26*b* formed along a direction in which the keys of the keyboard unit KBU are arranged (key arrangement direction) is crossed thereby in the direction of length of the key (the front-rear direction). When viewed from below, the grooves 30 are formed as six protrusions 22 protruding downward at respective locations corresponding thereto. It should be noted that it is not necessary to pass the flat cables 66 through all of the six grooves 30 since the grooves 30 are provided in a larger number so as to allow selection of only proper grooves from the six grooves 30 according to the type of the keyboard instrument, for passing the flat cables 66 therethrough.

Further, as shown in FIG. 7, portions of the floor part 26*b* having the above-described screw insertion holes 23 formed therein form contacted parts 26*b*1, respectively, and at a location forward of the contacted parts 26*b*1, there is formed a reinforcing rib 26*b*3 in a manner extending downward from a lower surface of the floor part 26*b*. Further, as shown in FIG. 8, portions of the floor part 26*b* having the above-described screw insertion holes 24 formed therein form a contacted part 26*b*2. A lower surface of the contacted part 26*b*2 form a contacted surface 26*b*2*a* having a downwardly-curved convex shape for contact with the fastening protrusions 35 of the rear-side lower case LCr. By forming the contacted surface 26*b*2*a* having the curved convex shape, it is possible to prevent a contacting part from being excessively deformed, even when the axial direction of a screw 64 is different depending on the type of keyboard instrument.

It should be noted that the angle of the contacting part 35*b* of the rear-side lower case LCr may be set depending on the type of keyboard instrument such that the contacted surface 26*b*2*a* is formed not as a curved convex surface but as a flat surface inclined to a predetermined angle to thereby cause the contacting part 35*b* to be brought into contact with the contacted surface 26*b*2*a* at a predetermined angle.

On the other hand, in the rear-side lower case LCr, as shown in FIG. 7, the fastening protrusions 33 are each comprised of a front wall 33*a*, a contacting part 33*b*, and a rear wall 33*c*. A lower surface of the contacting part 33*b* forms a contacted surface 33*b*1 that is brought into contact with the head of a screw 63. Further, as shown in FIGS. 3 and 8, the fastening protrusions 35 are each comprised of a front wall 35*a*, a contacting part 35*b*, and a rear wall 35*c*. A rising part 42 rises from a front part of a bottom plate 41 of the rear-side lower case LCr such that an upper part of the rising part 42 horizontally extends forward to be connected to the rear wall 35*c*. A lower surface of the contacting part 35*b* forms a contacted surface 35*b*1 for contact with the heads of the screw 64.

As shown in FIGS. 5 and 6, a rib 31 is approximately vertically formed from the front part of the bottom plate 41 of the rear-side lower case LCr. The rib 31 is integrally formed with the plurality of fastening protrusions 33 and 35, and extends between the fastening protrusions 35A and 35B in the left-right direction over almost the whole width of the rear-side lower case LCr with the fastening protrusions 33A and 33B arranged at respective intermediate locations between the fastening protrusions 35A and 35B. The rib 31 has six cutaway parts 32 formed therein for avoiding interference with projections 22 of the front-side lower case LCf, at respective locations corresponding thereto.

When the keyboard instrument 100 is assembled, as shown in FIG. 3 and FIGS. 6 to 8, the fastening protrusions 33 and 35 are fitted in the inside (recesses) of the gutter-shaped part 26 from below, and each contacting part 33*b* and the contacted part 26*b*1 associated therewith are brought into contact with each other, while each contacting part 35*b* and the contacted surface 26*b*2*a* of the contacted part 26*b*2 associated therewith are brought into contact with each other. Further, a contacting surface 16*b*, which is a lower end surface of each fastening protrusion 16 on the upper case UC, is brought into contact with a receiving surface 26*b*2*b*, which is an upper surface of the associated contacted part 26*b*2, from above (see FIG. 8).

As shown in FIGS. 6 and 7, the keyboard unit KBU has a known construction in which a plurality of white keys and black keys are laminated into three layers for each predetermined (e.g. one-octave) unit, each of the three layers is mounted on corresponding common base end 50. When the common base ends 50 are mounted on the front-side lower case LCf, the keyboard unit KBU becomes integral with the front-side lower case LCf to thereby form the keyboard-assembled front-side lower case KBLC. Each upper surface 51 of the common base end 50 has a curved convex shape in side view, and when the keyboard instrument 100 is assembled, the fastening protrusions 15 on the upper case UC are brought into contact with the upper surfaces 51. In assembling the keyboard unit KBU with the front-side lower case LCf, first, the common base ends 50 are placed on the upper surface 26*b*4 of the floor part 26*b* in a manner held between the guide rails 27*f* and 27*r*. Thus, the keyboard unit KBU is provisionally disposed, and then the common base ends 50 are fixed to the floor part 26*b* using a plurality of small screws, whereby the keyboard-assembled front-side lower case KBLC which has the keyboard unit KBU thereof supported by the floor part 26*b* is obtained. It should be noted that not only a substrate 68 provided with switches 67, etc., but also various functional components, such as stoppers, are mounted on the front-side lower case LCf, before the keyboard unit KBU is mounted.

As shown in FIG. 6, the keyboard instrument 100 is assembled by screwing the screws 61, 62, 63, 64, and 65 associated with the fastening protrusions 13, 14, 15, 16, and 17, respectively. The upper case UC is formed with a plurality of screw pilot holes circular in cross section, associated with the screws 61, 62, 63, 64, and 65, and the screws 61 to 65 are rotated to be screwed into the screw pilot holes associated therewith, while forming (thread rolling) female screws in the screw pilot holes.

In the intermediate connecting part CN2, assembly is performed using two screws 63A and 63B, and two screws 64A and 64B. First, as shown in FIGS. 7 and 8, screw pilot holes 15*a* and 16*a* are formed in the respective fastening protrusions 15 and 16 of the upper case UC. Referring to FIG. 7, the screws 63 are caused to pass through the screw insertion holes 34 and 23 and holes through the common base ends 50 from below, and screwed into the screw pilot holes 15*a* of the fastening protrusions 15. As a result, the rear-side lower case LCr, the front-side lower case LCf, the keyboard unit KBU, and the upper case UC are connected such that they are fixed in a state fastened together. Further, as shown in FIG. 8, the screws 64 are caused to pass through the screw insertion holes 36 and 24 from below, and screwed into the screw pilot holes 16*a* of the fastening protrusions 16. As a result, the rear-side lower case LCr, the front-side lower case LCf, and the upper case UC are connected such that they are fixed to each other in a state fastened together on the laterally opposite sides of the keyboard instrument 100.

Figure 9:
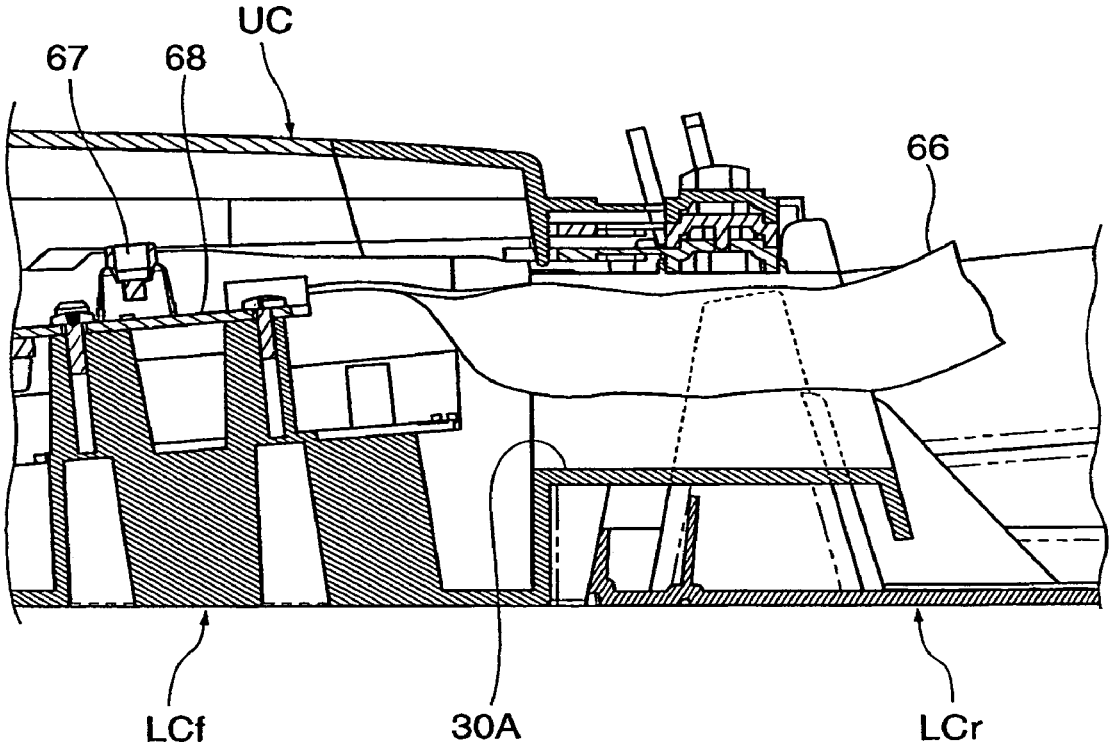
FIG. 9 is a cross-sectional view taken on line IX-IX of FIG. 2.

FIG. 9 is a cross-sectional view taken on line IX-IX of FIG. 2. In the front-side lower case LCf, six flat cables 66 for electrical wiring are connected to the substrate 68. After assembly of the keyboard instrument 100, as shown in FIG. 9 which illustrates the groove 30A, the flat cables 66 associated with the six grooves 30 of the rear-side lower case LCr are inserted into the six grooves 30, respectively. The grooves 30 are vertically elongated, and hence the flat cables 66 are arranged vertically parallel to each other for effective use of a limited space.

Figure 10B:
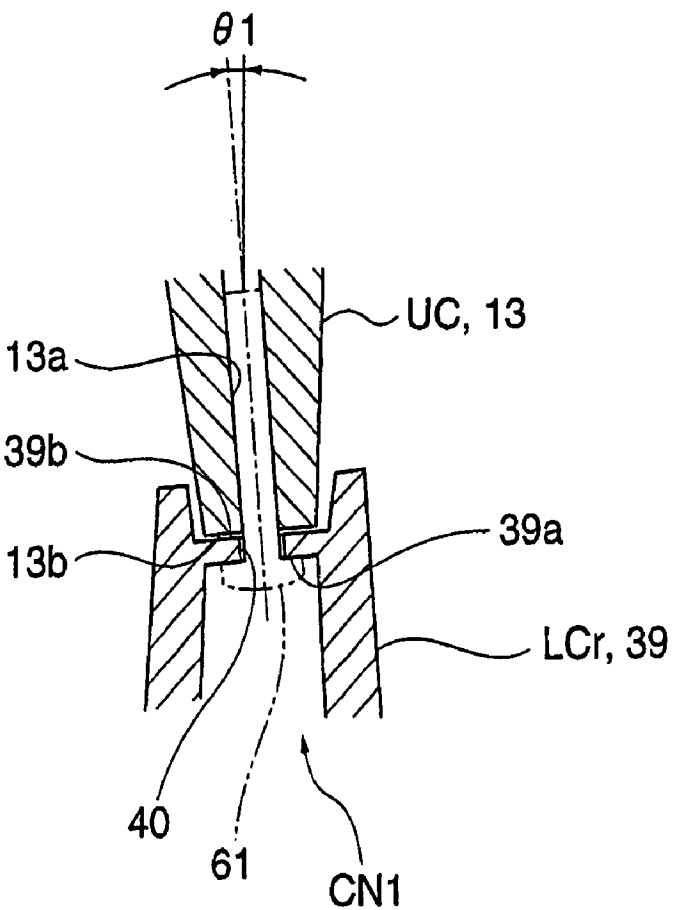
FIG. 10B is a fragmentary longitudinal cross-sectional view of a rear-side connecting part appearing in FIG. 3.
Figure 10A:
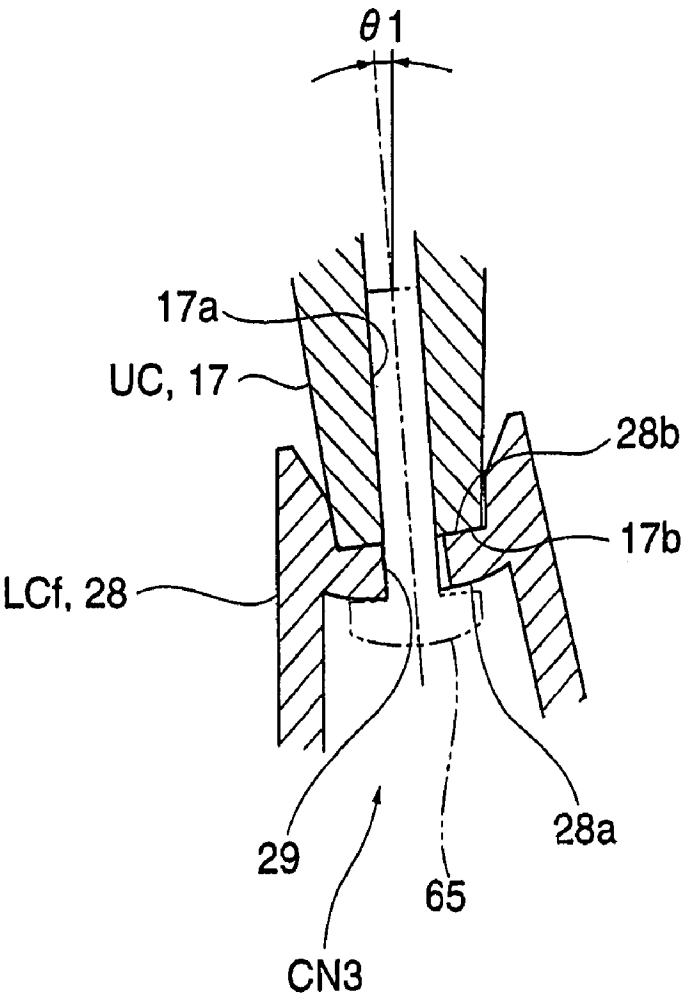
FIG. 10A is a fragmentary longitudinal cross-sectional view of a front-side connecting part appearing in FIG. 3.

FIG. 10A is a fragmentary longitudinal cross-sectional view of the front-side connecting part CN3, and FIG. 10B is a fragmentary longitudinal cross-sectional view of the rear-side connecting part CN1.

In the front-side connecting part CN3, as shown in FIG. 10A, each fastening protrusion 17 of the upper case UC is formed with a screw pilot hole 17*a*. Each fastening protrusion 28 of the front-side lower case LCf includes not only the screw insertion hole 29 (see FIG. 1), as described hereinabove, but also a receiving surface 28*b* for contact with a contacting surface 17*b*, which is a lower surface of the fastening protrusion 17, and a contacted surface 28*a*, which has a downwardly-curved convex shape, for contact with the head of the screw 65 associated therewith.

When the keyboard instrument 100 is assembled, the screws 65 are caused to pass through the screw insertion holes 29 from below, and screwed into the screw pilot holes 17*a* of the fastening protrusions 17, respectively. Thus, the front-side lower case LCf and the upper case UC are connected to each other in the front half of the keyboard instrument 100.

Further, in the rear-side connecting part CN1, as shown in FIG. 10B, each fastening protrusion 13 of the upper case UC is formed with a screw pilot hole 13*a*. Each fastening protrusion 39 of the rear-side lower case LCr includes not only the screw insertion hole 40 (see FIG. 1), as described hereinabove, but also a receiving surface 39*b* for contact with a contacting surface 13*b*, which is a lower surface of the fastening protrusion 13, and a contacted surface 39*a* for contact with the head of the screw 61 associated therewith. It should be noted that the construction (the fastening protrusion 14, the fastening protrusion 37, and the screw insertion hole 38) associated with the screw 62 is mainly distinguished only in the vertical positions of the components thereof from the construction associated with the screw 61, but basically the same construction, and therefore description thereof is omitted. Particularly, the screw pilot hole of the fastening protrusion 14 is configured similarly to the screw pilot hole 13*a*, and hence illustration thereof is omitted.

In assembling the keyboard instrument 100, the screws 61 are caused to pass through the screw insertion holes 40 from below, and screwed into the screw pilot holes 13*a* of the fastening protrusion 13, respectively. Similarly, the screw 62 as well is screwed into the screw pilot hole of the fastening protrusion 14. Thus, the rear-side lower case LCr and the upper case UC are fixedly connected to each other in the rear half of the keyboard instrument 100.

In the procedure of assembling the keyboard instrument 100, actually, the rear-side lower case LCr is assembled to the front-side lower case LCf after the keyboard unit KBU is assembled to front-side lower case LCf to thereby construct the keyboard-assembled front-side lower case KBLC. More specifically, first, the keyboard-assembled front-side lower case KBLC is constructed. Then, the keyboard-assembled front-side lower case KBLC is inverted and placed on a front half of the upper case UC disposed in an inverted state, and the rear-side lower case LCr is inverted and placed backward of the keyboard-assembled front-side lower case KBLC. In doing this, the rear-side lower case LCr is placed such that the front-side lower case LCf and the rear-side lower case LCr overlap each other at the intermediate connecting part CN2. After that, the screws 61 to 65 are screwed into the respective screw pilot holes associated therewith.

When the keyboard instrument 100 is assembled as described above, as shown in FIG. 3 and FIGS. 6 to 8, the hanging rib 26*c* and the rear wall 33*c*, the rising part 26*a* and the front wall 35*a*, the rising part 26*a* and the front wall 33*a*, the rising part 26*a* and the rib 31, the hanging rib 26*c* and the rear-wall 35*c*, the rib 26*b*3 and the front wall 33*a*, and the hanging rib 26*c* and the rising part 42 are arranged relatively close to each other in opposed relation. Thus, these walls which extend substantially vertically are arranged close to each other in opposed relation, so that "the lower case" formed by assembling the front-side lower case LCf and the rear-side lower case LCr has high rigidity in the horizontal direction. Moreover, since the fastening protrusions 33 and 35 are fitted in the inside of the gutter-shaped part 26, the lower case also has high rigidity in the key arrangement direction. Therefore, when attention is paid to the front-side lower case LCf and the rear-side lower case LCr, although the two cases LCf and LCr are formed separately from each other and assembled into the lower case, the lower case thus assembled can secure strength as high as that of a lower case formed in one piece.

Next, a description will be given of the keyboard instrument 200.

Figure 11:
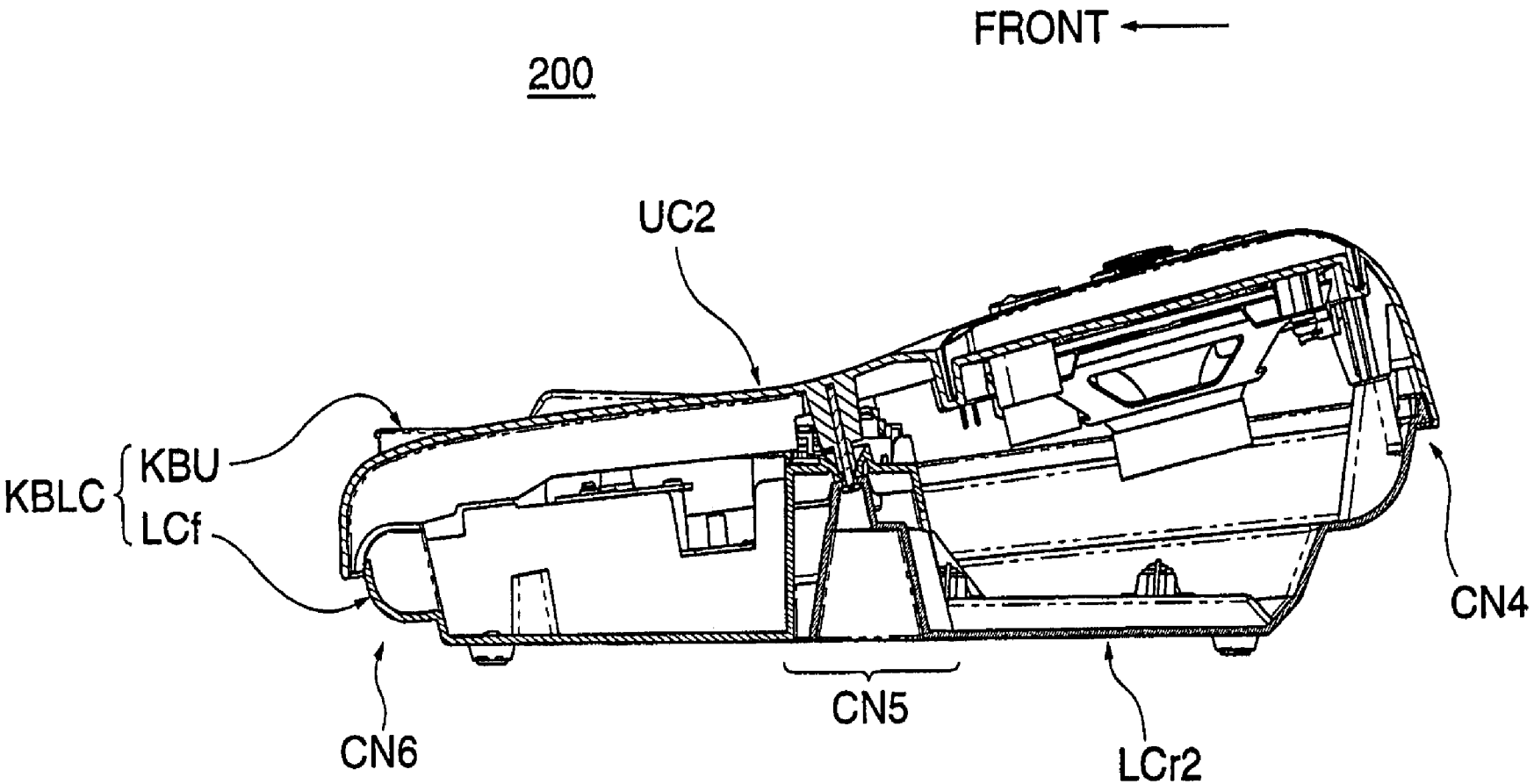
FIG. 11 is a cross-sectional view of the construction of a keyboard instrument, which corresponds to FIG. 3 showing the construction of the first keyboard instrument.

FIG. 11 is a cross-sectional view of the construction of the keyboard instrument 200, which corresponds to FIG. 3 showing the construction of the keyboard instrument 100. The keyboard instrument 200 is formed by assembling a rear-side lower case LCr2 different from the rear-side lower case LCr, and an upper case UC2 different from the upper case UC, to the front-side lower case LCf and the keyboard unit KBU used in common with the keyboard instrument 100. The rear-side lower case LCr2 and the upper case UC2 are connected to each other at a rear-side connecting part CN4 and an intermediate connecting part CN5; the front-side lower case LCf and the rear-side lower case LCr2 are connected to each other at the intermediate connecting part CN5; and the front-side lower case LCf and the upper case UC2 are connected to each other at the intermediate connecting part CN5 and a front-side connecting part CN6.

Figure 12:
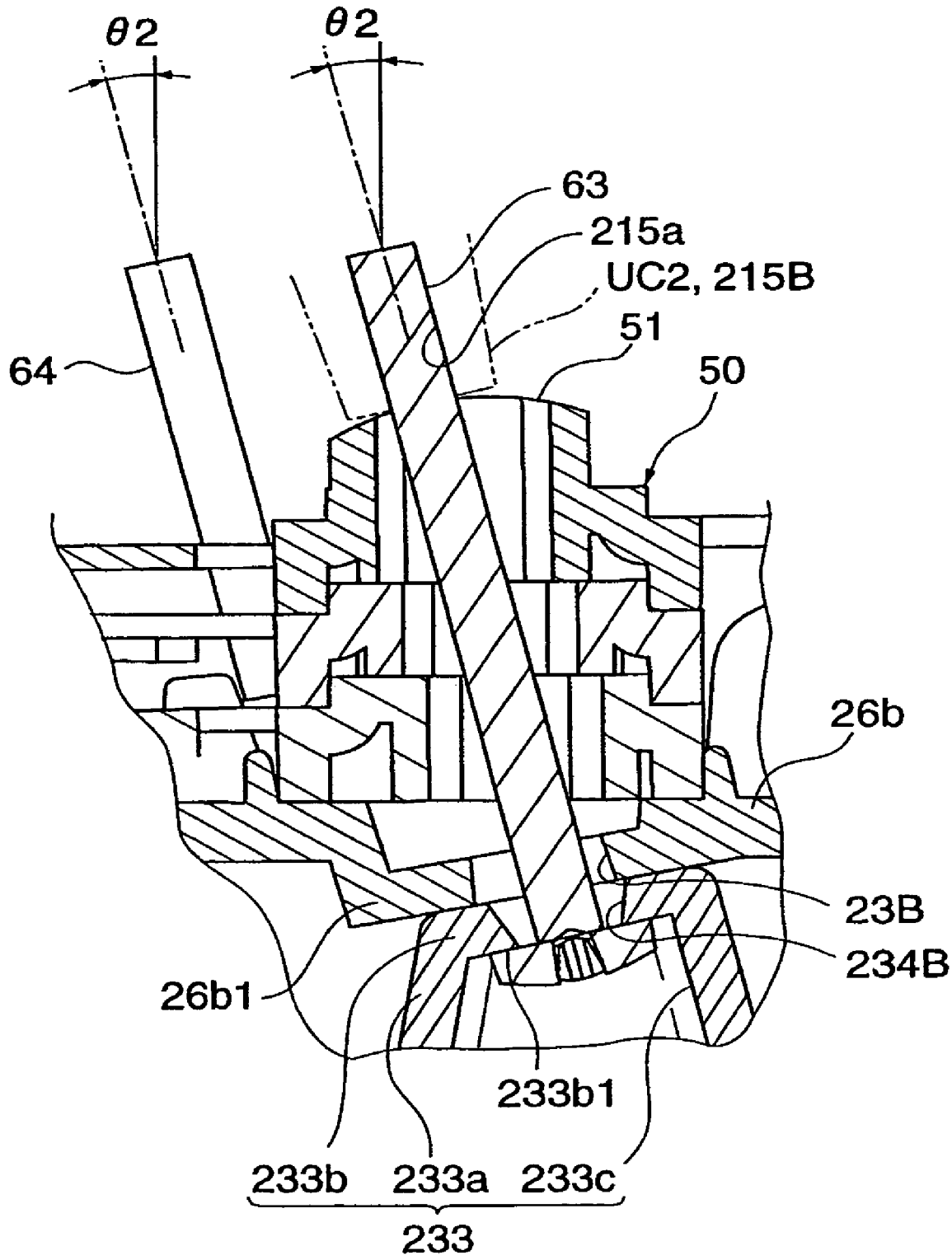
FIG. 12 is a fragmentary longitudinal cross-sectional view of an intermediate connecting part of the keyboard instrument shown in FIG. 11, which corresponds to FIG. 7 showing the first keyboard instrument.
Figure 13B:
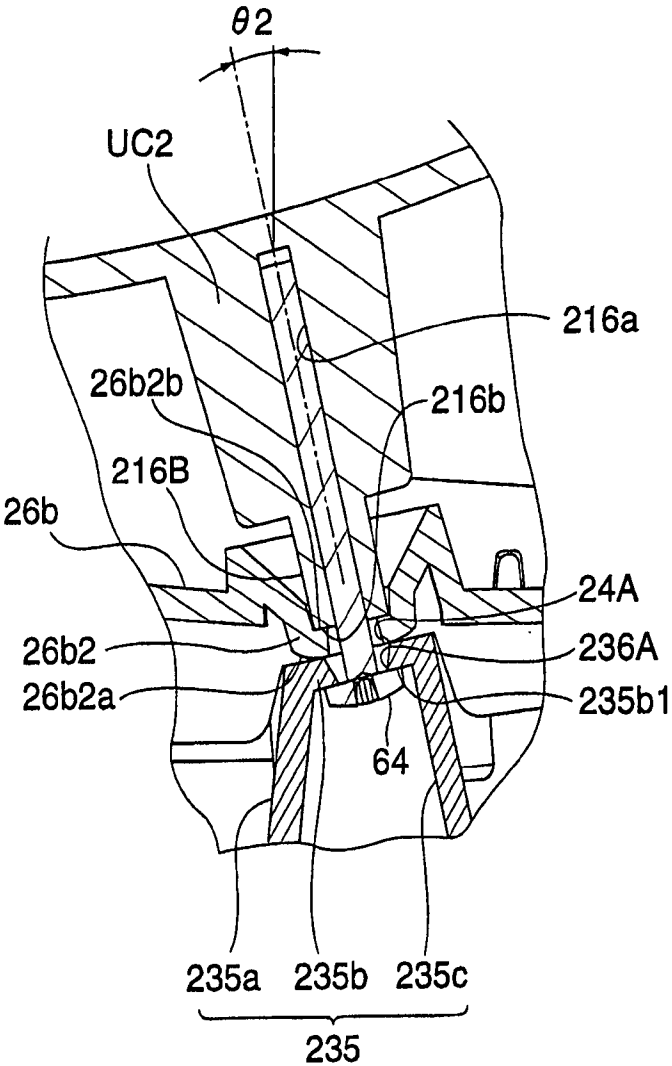
FIG. 13B is a fragmentary longitudinal cross-sectional view of the intermediate connecting part of the keyboard instrument shown in FIG. 11, which corresponds to FIG. 8 showing the first keyboard instrument.
Figure 13A:
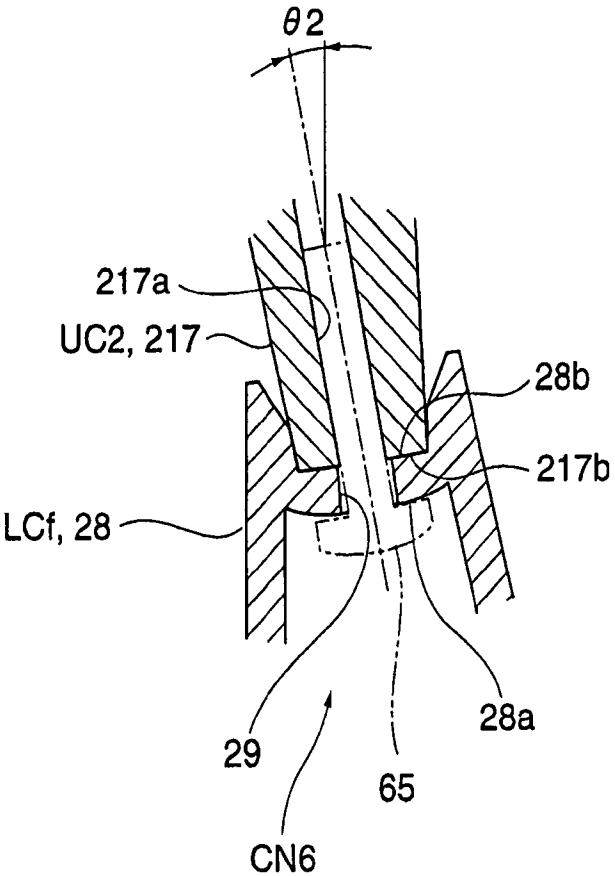
FIG. 13A is a fragmentary longitudinal cross-sectional view of a front-side connecting part of the keyboard instrument shown in FIG. 11, which corresponds to FIG. 10A showing the first keyboard instrument.

FIG. 12 is a fragmentary longitudinal cross-sectional view of the intermediate connecting part CN5, which corresponds to FIG. 7 showing the keyboard instrument 100. FIG. 13A is a fragmentary longitudinal cross-sectional view of the front-side connecting part CN6, which corresponds to FIG. 10A. FIG. 13B is a fragmentary longitudinal cross-sectional view of the intermediate connecting part CN5, which corresponds to FIG. 8.

The keyboard instrument 100 and the keyboard instrument 200 have a commonality in that the same screws 61 to 65 (see FIG. 2 for the screws 61 and 62) are used as fastening means for assembly. The upper case UC and the upper case UC2 are different from each other in the angle of a panel surface (upper surface), and accordingly in the angles of the screw pilot holes associated with the respective screws 61 to 65. More specifically, in the keyboard instrument 100, as shown in FIGS. 6 to 8, the angles of the screw pilot holes 13*a*, 15*a*, 16*a*, and 17*a*, and the angle of the screw pilot hole of the fastening protrusion 14 are all equal to θ1, and the angles of the screws 61 to 65 after fastening the same are also equal to θ1. Here, θ1 represents an angle of inclination in the forward direction with respect to the vertical direction when the keyboard instrument 100 is placed on a flat floor.

On the other hand, as shown in FIG. 12 and FIGS. 13A and 13B, the angles of the screw pilot holes 215*a*, 216*a*, and 217*a* corresponding to the respective screw pilot holes 15*a*, 16*a*, and 17*a* are all equal to θ2. Now, 74 2>θ1 holds. Further, although not shown, the respective angles of the screw pilot holes corresponding to the screw pilot holes 13*a* and the screw pilot hole of the fastening protrusion 14 are also equal to θ2. As described above, the angles of all the screw pilot holes are commonly equal to θ1 and θ2, in the keyboard instrument 100 and keyboard instrument 200, respectively, and therefore when the upper case UC and the upper case UC2 are molded, it is possible to easily form all the screw pilot holes without forming any undercut part, by changing vertically protruding upper and lower molds corresponding to the screw pilot holes.

Referring to FIGS. 12 and 13B, the intermediate connecting part CN5 of the keyboard instrument 200 has basically the same construction as that of the intermediate connecting part of the keyboard instrument 100 except for the difference between the angles θ1 and θ2 described above. Fastening protrusions 215 and 216, contacting surfaces 216*b*, fastening protrusions 233, front walls 233*a*, contacting parts 233*b*, rear walls 233*c*, contacted surfaces 233*b*1, screw insertion holes 234, fastening protrusions 235, front walls 235*a*, contacting parts 235*b*, rear walls 235*c*, and contacted surfaces 235*b*1 are formed similarly to the fastening protrusions 15 and 16, the contacting surfaces 16*b*, the fastening protrusions 33, the front walls 33*a*, the contacting parts 33*b*, the rear walls 33*c*, the contacted surfaces 33*b*1, the screw insertion holes 34, the fastening protrusions 35, the front walls 35*a*, the contacting parts 35*b*, the rear walls 35*c*, and the contacted surfaces 35*b*1, of the keyboard instrument 100, respectively. Further, as shown in FIG. 13A, the front-side connecting part CN6 of the keyboard instrument 200 also has basically the same construction as that of the front-side connecting part of the keyboard instrument 100 except for the difference between the angles θ1 and θ2 described above. Fastening protrusions 217 and contacting surfaces 217*b* of the keyboard instrument 200 are formed similarly to the fastening protrusions 17 and the contacting surfaces 17*b* of the keyboard instrument 100.

Now, referring to FIGS. 7 and 12, first, in the keyboard instrument 100 and the keyboard instrument 200, the front-side lower case LCf and the keyboard unit KBU are commonly used, but the angles of the screw pilot holes 15*a* and 215*a* are different from each other. Therefore, the fastening protrusions 15 of the upper case UC and the fastening protrusions 215 of the upper case UC2 are brought into contact with the upper surfaces 51 of the common base ends 50 at different locations from each other. However, since each upper surface 51 has a curved convex shape in side view, excellent contact with the upper surfaces 51 is ensured for both the fastening protrusions 15 and the fastening protrusion 215. Further, the contacted surfaces 33*b*1 and 233*b*1 are formed at such angles that they are brought into appropriate surface contract with the head of the screw 63, when the screw 63 is screwed into each of the screw pilot holes 15*a* and 215*a*. Such configurations are possible since the rear-side lower case LCr and the rear-side lower case LCr2 are molded separately from each other. Therefore, in both types of keyboard instrument, it is possible to properly fasten the screws 63, while commonly using or sharing the keyboard-assembled front-side lower case KBLC between them.

Next, as shown in FIGS. 10A and 13A, the front-side lower case LCf is commonly used or shared by the keyboard instruments 100 and 200, so that the angle and the shape of the receiving surface 28*b* are also common to the keyboard instruments 100 and 200. Therefore, in the upper case UC2 of the keyboard instrument 200, the contacting surface 217*b* of the fastening protrusion 217 is formed such that it is brought into surface contact with the receiving surface 28*b*, similarly to the contacting surface 17*b* of the fastening protrusion 17. Further, since the angle of the screw pilot hole 17*a* and that of the screw pilot hole 217*a* are different from each other, the keyboard instruments 100 and 200 are different in a location where the head of the screw 65 is brought into contact with the contacted surface 28*a* when the screw 65 is screwed into each of the screw pilot holes 17*a* and 217*a*. However, as described hereinabove, the contacted surface 28*a* has a curved convex shape, and hence is held in excellent state contact with the head of the screw 65, compared with the case of the contacted surface 28*a* being flat. Therefore, in both types of keyboard instrument, it is possible to properly fasten the screws 65, while commonly using the front-side lower case LCf.

Next, as shown in FIGS. 8 and 13B, the front-side lower case LCf is shared by the keyboard instruments 100 and 200, so that the angles of the contacted part 26*b*2 and the receiving surface 26*b*2*b* are also common to the keyboard instruments 100 and 200. Therefore, first, in the upper case UC2 of the keyboard instrument 200, the contacting surface 216*b* of the fastening protrusion 216 is formed such that it is brought into surface contact with the receiving surface 26*b*2*b*, similarly to the contacting surface 16*b* of the fastening protrusion 16. Further, in the rear-side lower case LCr2, the contacted surface 235*b*1 is formed, similarly to the contacted surface 35*b*1 at such an angle that it is brought into appropriate surface contract with the head of the screw 64 when the screw 64 is screwed into the screw pilot hole 216*a*. Furthermore, since the contacted surface 26*b*2*a* has a curved convex shape, the contacting part 235*b* of the fastening protrusion 235 and the contacted surface 26*b*2*a* are held in excellent contact, similarly to the case of the keyboard instrument 100. Therefore, in both types of keyboard instrument, it is possible to properly fasten the screw 64 while commonly using the front-side lower case LCf therebetween.

Although not shown, the fastened part of the rear-side connecting part CN4 is a part where the upper case UC2 and the rear-side lower case LCr2 are connected and fastened to each other, and therefore it is possible to design the angles and the shapes of contact parts and so forth according to angle θ2, which is an angle at which the screws 61 and 62 fasten the two cases UC2 and LCr2, for the keyboard instrument 200, independently of the keyboard instrument 100. This makes it possible to achieve proper fastening of the screws 61 and 62 without special contrivance.

Figure 14:
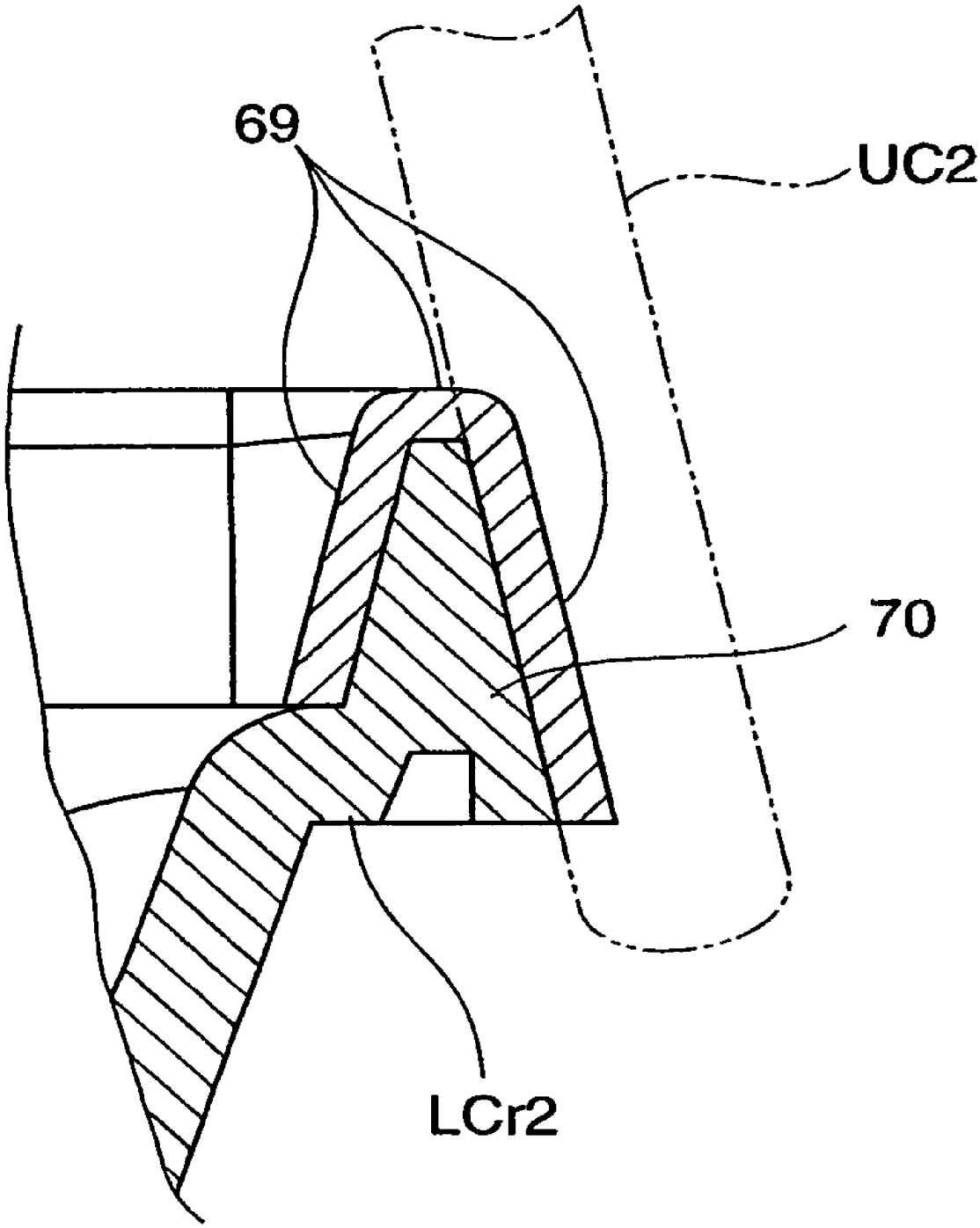
FIG. 14 is a fragmentary longitudinal cross-sectional view of a rear-side connecting part of the keyboard instrument shown in FIG. 11.

FIG. 14 is a fragmentary longitudinal cross-sectional view of the rear-side connecting part CN4 of the keyboard instrument 200. As is distinct from the keyboard instrument 100, the keyboard instrument 200 is provided with a packing 69. The packing 69 is disposed in a manner covering a rear edge 70 of the rear-side lower case LCr2, while the upper case UC2 covers the rear edge 70 from outside with the packing 69 sandwiched therebetween. This enables the keyboard instrument 200 to suppress noises caused by vibrations and rattle during generation of musical tones.

Next, a description will be given of the keyboard instrument 300.

FIG. 15 is a cross-sectional view of the construction of the keyboard instrument 300, which corresponds to FIG. 3. The keyboard instrument 300 is constructed by assembling a rear-side lower case LCr3 different from the rear-side lower case LCr and an upper case UC3 different from the upper case UC, to the front-side lower case LCf and the keyboard unit KBU commonly used in the keyboard instrument 100. The rear-side lower case LCr3 and the upper case UC3 are connected to each other at a rear-side connecting part CN7 and an intermediate connecting part CN8; the front-side lower case LCf and the rear-side lower case LCr3 are connected to each other at the intermediate connecting part CN8; and the front-side lower case LCf and the upper case UC3 are connected to each other at the intermediate connecting part CN8 and a front-side connecting part CN9.

Similarly to the case of the keyboard instrument 200, the keyboard instrument 300 is different from the keyboard instrument 100 in the angle of the screw pilot holes associated with the screws 61 to 65 as fastening means for use in assembly (angle θ3). In the constructions associated with the screws 61 to 65, the angles and the shapes of contact parts and so forth are designed according to the angle θ3 to ensure the appropriate contact. For example, a fastening protrusion 335 corresponding to the fastening protrusion 35 is provided such that the screw 64 can be screwed into a screw pilot hole formed at the angle θ3. Particularly, the keyboard instrument 300 has speakers 71 disposed in rear parts of the upper case UC3 and the rear-side lower case LCr3, and is reduced in length in the front-rear direction, which makes the keyboard instrument 300 very different in external appearance from the keyboard instruments 100 and 200.

According to the present embodiment, the case structure for internally mounting the keyboard unit KBU therein is constructed by three cases, and one of the rear-side lower cases LCr, LCr2, and LCr3, and one of the upper cases UC, UC2, and UC3 are selectively mounted on the keyboard-assembled front-side lower case KBLC which is single in type and comprised of the front-side lower case LCf and the keyboard unit KBU, to thereby enable construction of a plurality of types of case structures. This makes it possible to share the keyboard-assembled front-side lower case KBLC between the case structures to thereby dramatically increase the variation of producible types of keyboard instrument while suppressing the cost of molds, compared with cases in which different types of upper case and lower case are used depending on the type of keyboard instrument as in the conventional case structure. For example, it is possible not only to share the keyboard-assembled front-side lower case KBLC between keyboard instruments of types different in panel angle of the upper case but also to share the keyboard-assembled front-side lower case KBLC between keyboard instruments that are completely different in depth and external appearance, by changing the rear-side lower case LCr and the upper case UC of the keyboard instrument 100 with the rear-side lower case LCr3 and the upper case UC3, as shown in the keyboard instrument 300 by way of example. Since the length of the keyboard instrument in the front-rear direction, and the shape thereof in plan view are not dependent on the front-side lower case LCf, there is less restriction on changes in the length in the front-rear direction and the shape in plan view of the keyboard instrument even if the front-side lower case LCf is shared.

Further, as described hereinbefore as to the keyboard instrument 100 with reference to FIGS. 1 to 10 by way of example, out of the plurality of screw pilot holes of the upper case UC, the screw pilot holes 13*a*, 16*a*, and 17*a* are arranged in the left and right side sections 12L and 12R, and hence the front-side lower case LCf and the rear-side lower case LCr are secured to each other using the left and right side sections 12L and 12R of the upper case UC extending almost over the length of the keyboard instrument 100 in the front-rear direction, practically as connecting parts. This makes it possible to enhance the rigidity of the assembled case structure in the front-rear direction.

Further, as described hereinbefore as to the keyboard instrument 100 by way of example, when the case structure is constructed by assembling the upper case UC, the front-side lower case LCf, and the rear-side lower case LCr, the floor part 26*b* of the gutter-shaped part 26 of the front-side lower case LCf extends on the contacting parts 33*b* and 35*b* of the rear-side lower case LCr in an overlapping manner, and at the same time the common base ends 50 of the keyboard unit KBU are substantially supported by the floor part 26*b*. In other words, a keyboard unit-supporting part supporting the keyboard unit KBU belongs only to the front-side lower case LCf without depending on the rear-side lower case LCr or the upper case UC. Therefore, the keyboard unit KBU requiring high positioning accuracy hardly suffers from unacceptable degradation of positioning accuracy due to the mounting thereof on the keyboard instrument 100.

Furthermore, the floor part 26*b* is located at the intermediate connecting part CN2, i.e. provided at a location where the front-side lower case LCf and the rear-side lower case LCr overlap each other, and at the overlapping location, the front-side lower case LCf and the rear-side lower case LCr are fixed to the upper case UC by screwing the screws 63 and 64 into the screw pilot holes 15*a* and 16*a* of the upper case UC, while holding the floor part 26*b* in contact with the contacting parts 33*b* and 35*b* of the rear-side lower case LCr. This makes it possible to increase the strength of the intermediate connecting part CN2 that serves as a connecting part for connecting between the front-side lower case LCf and the rear-side lower case LCr, whereby it is possible to solve the problem of insufficient rigidity of the whole case structure, which would be otherwise caused when the lower case is formed from the two separately formed members. Moreover, since the keyboard unit KBU is supported in the vicinity of the part fastened by the screws 63 and 64 (i.e. on the floor part 26*b*), it is possible to improve the positioning accuracy of the keyboard unit KBU to thereby solve the problem of degradation of the positioning accuracy of the keyboard unit KBU.

According to the present embodiment, when the case structure is constructed by assembling the upper case UC, the front-side lower case LCf, and the rear-side lower case LCr, the walls along the vertical direction, such as the hanging rib 26*c* of the front-side lower case LCf, the rear wall 33*c* of the rear-side lower case LCr, and so forth, are arranged close to each in opposed relation, so that the strength of the assembly of the lower cases (the front-side lower case LCf and the rear-side lower case LCr) mainly in the front-rear direction thereof is increased. Moreover, since the fastening protrusions 33 and 35 are fitted into the gutter-shaped part 26, the rigidity of the lower cases also becomes higher not only in the front-rear direction thereof but also in the key arrangement direction thereof. Accordingly, in the case structure formed by connecting three separately-formed cases, it is possible to increase the connecting strength of the lower cases to thereby ensure high rigidity of the case structure.

Further, the front-side lower case LCf, the rear-side lower case LCr, and the upper case UC are fastened together in the intermediate connecting part CN2, which makes it possible to reduce the number of component parts.

Furthermore, the guide rails 27*f* and 27*r* formed on the floor part 26*b* are brought into contact with the common base ends 50 of the keyboard unit KBU, and used as provisional positioning references in the front-rear direction of the common base ends 50. This facilitates the operation for assembling the keyboard unit KBU, and at the same time contributes to increasing the rigidity of the lower case in the key arrangement direction, since the guide rails 27*f* and 27*r* have a ridge shape extending in the key arrangement direction.

Further, the bottom plate 25 of the front-side lower case LCf and the bottom plate 41 of the rear-side lower case LCr are flush with each other. This causes the lower cases to appear as a unitary member with no downward projections, though they are formed by connecting two separate members. Moreover, the gutter-shaped part 26 is C-shaped and open downward, and includes a plurality of ribs, such as the rib 26*b*3 and the rib 31. This makes it difficult for foreign matter to enter the case structure from below the gutter-shaped part 26.

It should be noted that as described above, it is possible to produce a large number of types of keyboard instruments by a selective combination of rear-side lower cases LCr and upper cases UC, and the producible types of keyboard instruments are by no means limited to the keyboard instruments 100, 200, and 300, illustrated by way of example.

Although the floor part 26*b* directly supporting the keyboard unit KBU is disposed in the front-side lower case LCf, insofar as the purpose of maintaining the positioning accuracy of the keyboard unit KBU is concerned, the floor part may be provided in a reversed configuration. More specifically, by forming the floor part in the rear-side lower case LCr and arranging contacting parts corresponding to the contacting parts 33*b* and 35*b* as parts associated with the floor part 26*b* in the front-side lower case LCf, the floor part of the rear-side lower case LCr may extend on the contacting parts in an overlapping manner.

Insofar as attaining the purpose of functioning as provisional positioning reference of the common base ends 50 of the keyboard unit KBU is concerned, members for attaining the purpose do not necessarily have a ridge shape, as in the shape of the guide rails 27*f* and 27*r*, but they may have a shape of a projection. Further, it is not necessary to provide both of the guide rails 27*f* and 27*r* but only one of them may be provided.

It should be noted that the fastening protrusions 16 may be included not only in the first fastening part as recited in claim 5 but also in the second fastening part.

What is claimed is:

1. A structure for a keyboard instrument, including a case structure for mounting a keyboard unit therein, comprising:

a lower case including a front-side lower case, and a rear-side lower case disposed rearward of said front-side lower case in a side-by-side fashion; and an upper case disposed above said lower case, wherein said front-side lower case and said rear-side lower case are not integral and are coupled to each other in a region not substantially overlapping with the keyboard unit in a front-rear direction, and wherein said front-side lower case is fastened to said upper case in at least said region and said rear-side lower case is fastened to said uppercase in at least said region, whereby said lower case is secured to said upper case.

2. A structure as claimed in claim 1, wherein said upper case has at least one first fastening part and at least one second fastening part, said front-side lower case having at least one first fastening part-associated part that is associated with said first fastening part of said upper case and includes a contact surface curved in cross section, and having at least one second fastening part-associated part that is associated with said second fastening part of said upper case and includes a contact surface curved in cross section, and the structure further comprising at least one first fastening member for fastening said first fastening part of said upper case and said first fastening part-associated part of said front-side lower case and at least one second fastening member for fastening said second fastening part of said upper case and said second fastening part-associated part of said front-side lower case, and wherein said first fastening member is fixed to a fixing part of said first fastening part, said second fastening member is fixed to a fixing part of said second fastening part, said first fastening member is brought into contact with the contact surface of said first fastening part-associated part, and said second fastening member is brought into contact with the contact surface of said second fastening part-associated part.

3. A structure as claimed in claim 1, wherein said lower case includes at least one guide part for guiding a cable for electrical wiring of the keyboard unit in a rearward direction.

4. A structure as claimed in claim 1, wherein said upper case has at least one third fastening part, said rear-side lower case having at least one third fastening part-associated part associated with said third fastening part of said upper case, and the structure further comprising at least one third fastening member for fastening said third fastening part of said upper case and said third fastening part-associated part of said rear-side lower case.

5. A structure as claimed in claim 1 further comprising a speaker provided between said rear-side lower case and an associated part of said upper case associated with said rear-side lower case.

6. A structure for a keyboard instrument, including a case structure for mounting a keyboard unit therein, comprising:

an upper case including at least one first fastening part and at least one second fastening part;

a front-side lower case including at least one first fastening part-associated part associated with said first fastening part of said upper case; and a rear-side lower case disposed below said upper case and rearward of said front-side lower case, and including at least one second fastening part-associated part associated with said second fastening part of said upper case, wherein said front-side lower case and said-rear side lower case are not integral and are coupled to each other in a region not substantially overlapping with the keyboard unit in a front-rear direction and wherein said first fastening part of said upper case and said first fastening part associated part of said front-side lower case are fastened to each other in at least said region, and said second fastening part of said upper case and said second fastening part-associated part of said rear-side lower case are fastened to each other in at least said region, whereby said front-side lower case and said rear-side lower case are secured to said upper case to thereby construct the case structure.

7. A structure as claimed in claim 6, wherein said front-side lower case and said rear-side lower case have overlapping parts at which said front-side lower case and said rear-side lower case are coupled to each other in a manner overlapping each other in the front-rear direction, the structure comprising a keyboard unit-supporting part for supporting the keyboard unit being formed at said overlapping parts of said front-side lower case and said rear-side lower case.

8. A structure as claimed in claim 6, wherein said upper case includes left and right side sections extending over a length of the case structure in the front-rear direction thereof, and said left and right sections have at least one first fastening part and at least one second fastening part, respectively.

9. A structure for a keyboard instrument, including a case structure, comprising:

a plurality of respective types of upper cases;

a plurality of respective types of rear-side lower cases; and a single type of a front-side lower case for supporting a keyboard unit, wherein the case structure is constructed by selectively mounting one of said plurality of respective types of upper cases and one of said plurality of respective types of rear-side lower cases to said front-side lower case in a region not substantially overlapping with the keyboard unit in a front-rear direction, said front-side lower case and said one of said plurality of respective types of rear-side lower cases are not integral and are coupled to each other in said region.

10. A structure for a keyboard instrument, including a case structure for mounting a keyboard unit therein, comprising:

an upper case;

a front-side lower case;

a rear-side lower case disposed below said upper case and rearward of said front-side lower case; and a fastening device, wherein the case structure is constructed by assembling said upper case, said front-side lower case, and said rear-side lower case, said front-side lower case and said-rear side lower case are not integral and are coupled to each other in a region not substantially overlapping with the keyboard unit in a front-rear direction, and wherein said front-side lower case and said rear-side lower case each have a wall extending in a substantially vertical direction, and wherein said wall of said front-side lower case and said wall of said rear-side lower case are arranged close to each other in opposed relation, when said upper case, said front-side lower case, and said rear-side lower case are assembled to each other, and fastened by said fastening device in at least said region.

11. A structure as claimed in claim 10, wherein one of said front-side lower case and said rear-side lower case has a floor part, and the other of said front-side lower case and said rear-side lower case has a floor part-associated part associated with said floor part, said floor part being formed to extend in a manner continued from said wall of the one of said front-side lower case and said rear-side lower case, said upper case, said front-side lower case, and said rear-side lower case being assembled to each other by bringing said floor part and said floor part-associated part into contact with each other, and fastening said front-side lower case and said rear-side lower case to said upper case by said fastening device at parts of said floor part and said floor part-associated part via which said floor part and said floor part-associated part are in contact with each other.

12. A structure as claimed in claim 11, wherein said floor part has a keyboard unit-supporting part for supporting the keyboard unit, and said floor part extends on said floor part-associated part in an overlapping manner when said upper case, said front-side lower case, and said rear-side lower case are assembled to each other.

13. A structure as claimed in claim 12, wherein said keyboard unit-supporting part has a protrusion for contact with the keyboard unit so as to function as a positioning reference of the keyboard unit in a front-rear direction thereof.

14. A structure for a keyboard instrument, including a case structure for mounting a keyboard unit therein, comprising:

an upper case;

a front-side lower case including a bottom plate part;

a rear-side lower case disposed below said upper case and rearward of said front-side lower case; and a fastening device, wherein the case structure is constructed by assembling said upper case, said front-side lower case, and said rear-side lower case, said front-side lower case and said-rear side lower case are not integral and are coupled to each other in a region not substantially overlapping with the keyboard unit in a front-rear direction said front-side lower case having a gutter-shaped part formed such that said gutter-shaped part rises from a rear part of said bottom plate part to define a recess opening downward, said gutter-shaped part having a keyboard unit-supporting part formed in an upper part thereof, for supporting the keyboard unit, said rear-side lower case having at least one connecting protrusion formed at a front part thereof in a manner protruding upward for being fitted into the recess of said gutter-shaped part, and said fastening device fastening said upper case, the keyboard unit, said front-side lower case, and said rear-side lower case to each other in at least said region via contact parts of said gutter-shaped part and said connecting protrusion where said gutter-shaped part and said connecting protrusion are brought into contact with each other in a vertical direction, by fitting said connecting protrusion into the recess of said gutter-shaped part.

15. A structure for a keyboard instrument, including a case structure that includes a lower case and an upper case, wherein said lower case includes a front-side lower case and a rear-side lower case, wherein said front-side lower case has an upper face thereof on which a keyboard unit is disposed to have a free end thereof directed forwardly and a key support thereof directed rearwardly, wherein said front-side lower case and said-rear side lower case are not integral and are coupled to each other in a region not substantially overlapping with the keyboard unit in a front-rear direction and wherein a rear part of said front-side lower case, which faces the key support, and a front part of said rear-side lower case are fastened to each other through a fastening device in at least said region.

* * * * *